US006918346B2

(12) United States Patent
Grenier

(10) Patent No.: US 6,918,346 B2
(45) Date of Patent: Jul. 19, 2005

(54) MARINE CRAFT TOWED BY A KITE-TYPE CANOPY

(76) Inventor: Maurice Grenier, 3, rue Camille Tahan, Paris (FR), 75018

( * ) Notice: Subject to any disclaimer, the term of this patent is extended or adjusted under 35 U.S.C. 154(b) by 0 days.

(21) Appl. No.: 10/472,891

(22) PCT Filed: Mar. 22, 2002

(86) PCT No.: PCT/FR02/01017

§ 371 (c)(1),
(2), (4) Date: Sep. 25, 2003

(87) PCT Pub. No.: WO02/079030

PCT Pub. Date: Oct. 10, 2002

(65) Prior Publication Data

US 2004/0099196 A1 May 27, 2004

(30) Foreign Application Priority Data

Mar. 29, 2001 (FR) ..... 01 04293

(51) Int. Cl.[7] ..... B63H 9/04; B63B 35/00
(52) U.S. Cl. ..... 114/102.16; 114/39.11
(58) Field of Search ..... 114/39.11, 39.21, 114/102.1, 102.16, 102.17, 102.18, 102.19, 102.2, 102.21, 102.28, 102.29, 102.3

(56) References Cited

U.S. PATENT DOCUMENTS 4,497,272 A * 2/1985 Veazey ..... 114/102.29
4,788,924 A * 12/1988 Hamel ..... 114/102.21
5,076,186 A * 12/1991 Girard ..... 114/39.29
5,355,817 A * 10/1994 Schrems ..... 114/39.28
5,642,683 A * 7/1997 Bedford ..... 114/102.1
6,003,457 A * 12/1999 Chatelain ..... 114/39.11

FOREIGN PATENT DOCUMENTS

| | | |
|---|---|---|
| DE | 20 36 147 | 2/1971 |
| DE | 35 18 131 | 11/1986 |
| DE | 87 02 480 | 6/1988 |
| DE | 199 28 166 | 2/2000 |
| FR | 2 639 605 | 6/1990 |

* cited by examiner

*Primary Examiner*—Andrew D. Wright
(74) *Attorney, Agent, or Firm*—Young & Thompson

(57) ABSTRACT

A marine craft includes a floating body, elements adapted to generate a center-board effect, in particular a center-board projecting beneath the floating body, and a rigging. The rigging includes at least a directional kite forming a canopy and a series of sheets controlling the canopy linked to the craft, the series of sheets including a main sheet and two directional sheets, and a substantially punctiform member for guiding the main sheet and for applying tractive force of the sheet on the craft. The rigging further includes elements for spatial orientation of the axis of the resultant elements the tractive force exerted by the rigging on the craft so as to almost completely eliminate the list whatever the moving speed of the craft and with the guiding and force-applying member located above the water level.

24 Claims, 17 Drawing Sheets

MARINE CRAFT TOWED BY A KITE-TYPE CANOPY

BACKGROUND OF THE INVENTION

The present invention relates to a water craft.

The use of a kite as a means for towing a craft is known per se, but it is not enjoying any particular development because of the often poor stability of a kite sail, because of its low propulsion efficiency when sailing close to the wind, and because of the difficulties launching the sail and bringing it back down.

Propelling a craft by using the force of the wind is currently in very wide use by means of a "traditional" rig in which one or more sails are deployed by means of masts and ropes. Depending on the "point of sailing", i.e. the course of the craft relative to the direction of the wind, the sail is positioned so that its leading edge or "luff" is disposed substantially tangentially to the direction of the apparent wind in order to maximize the propulsion component transmitted to the craft.

However, the sail filled by the wind in this way also generates a capsizing component directed substantially transversely to the craft. As is known in sailing, the capsizing component and the lateral resistance component or "leeward drift reaction component" of the floating body of the craft generate tilting torque causing the craft to heel over. This phenomenon explains, in particular, why it is impossible to increase the sail area as much as would be liked without running the risk of causing the craft to capsize.

SUMMARY OF THE INVENTION

An object of the invention is to propose a craft of the above-mentioned type that enables a very large sail area to be made available, and that limits the drawbacks relating to kite sails.

To this end, the invention provides a craft of the above-mentioned type and that has the characteristics disclosed below.

BRIEF DESCRIPTION OF THE DRAWINGS

The invention will be better understood on reading the following description given merely by way of example and with reference to the accompanying drawings, in which.

A description follows of examples of sailcraft designed to sail on various "points of sailing", i.e. at various angles to the wind. More precisely, and as defined in the "Cours des Glénans" sailing manual (published by Editions du Seuil, June 1999), the point of sailing designates the angle formed by the course of the craft relative to the true wind. The point of sailing thus specifies the position of the craft when the direction of the wind is known exactly. When the longitudinal direction of the craft is perpendicular to the true wind, the craft is said to be "reaching" and more precisely sailing on a "beam reach" with the "wind abeam". When the angle between the direction of the craft and the direction of the true wind is less than 90°, the craft is said to be "close-hauled", comprising the following points of sailing in succession as the value of said angle decreases: "close reach", "fetch", and "beat" or "hard on the wind". When said angle is greater than 90°, the craft is said to be "running", comprising the following points of sailing as the angle increases towards 180°: "broad reach", "run", and "square run".

Figure 1A:
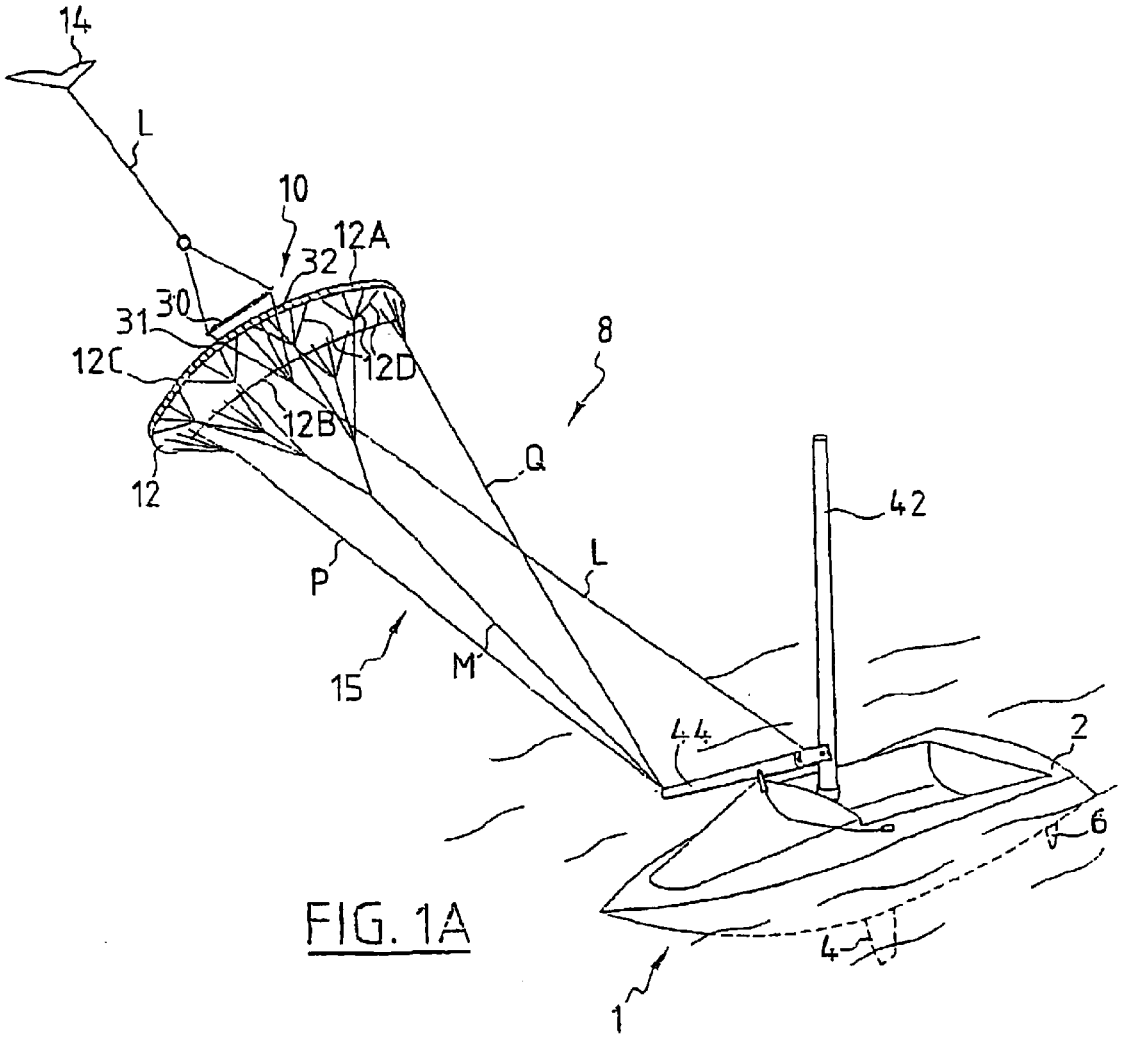
FIG. 1A is a diagrammatic perspective view of a craft of the invention.

FIG. 1A shows a water craft 1 of the invention, comprising a floating body having a portion above the water and a portion below the water, a first leeboard 4 situated in the midplane of the craft, underneath and substantially midway along the floating body, and a second leeboard 6 situated in the same plane and below the floating body, but at the stern end of the craft 1.

It should be noted that the elements of the example of the craft shown that do not participate in the invention are shown highly diagrammatically and do not limit the invention in any way. However, as described in more detail below, the invention applies to various types of craft, sometimes having particular configurations. Thus, the first example described below with reference to FIGS. 1 to 15 shows the preferred use of the invention to a craft of the single-hull sailboat type.

The craft 1 of FIG. 1A is provided with a rig 8. The term "rig" is to be understood in its broadest sense, namely a set of masts, poles, sails and control tackle required to propel a sailboat. The rig B comprises a sail 10 constituted by a main kite 12, an auxiliary kite 14, and a series 15 of cords known as "sheets" for controlling the sail 10 and comprising a main traction sheet M, two directional sheets P and Q, and a launching sheet L, the sheets M, P, Q, and L connecting the sail 10 to the craft 1.

The main kite 12 is a kite similar to a parafoil, i.e. a flexible, lightweight canopy that has a large area and that is sufficiently fine. It is easy to furl and to stow. Substantially elliptical in shape, it is made up of a plurality of chambers disposed parallel to the minor axis of the ellipse. The kite 12 is not described in detail, because it is known per se from the prior art. However, the important characteristics of the parafoil canopy 12 should be noted, namely:

its leading edge 12A corresponding to the "luff" of the sail disposed facing the wind;

its trailing edge or "leech" 12B opposite from the leading edge;

its curvature 12C; and its control sheets M, P, and Q which are connected to the canopy via shroud lines 12D, and which are adapted both to transmit traction force exerted by the sail to the craft 1, and also to act from the craft to steer the sail relative to the wind.

Figure 1B:
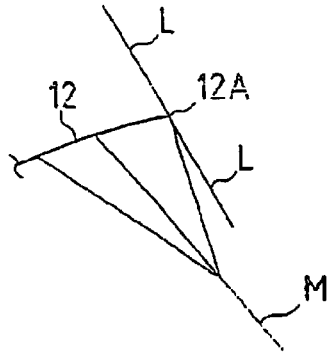
FIG. 1B is a diagrammatic view of a detail of the sail of the craft of FIG. 1.

In the invention, and as shown diagrammatically in FIG. 1B the kite 12 is also connected to the craft at its leading edge 12A via the launching sheet L.

Figure 2:
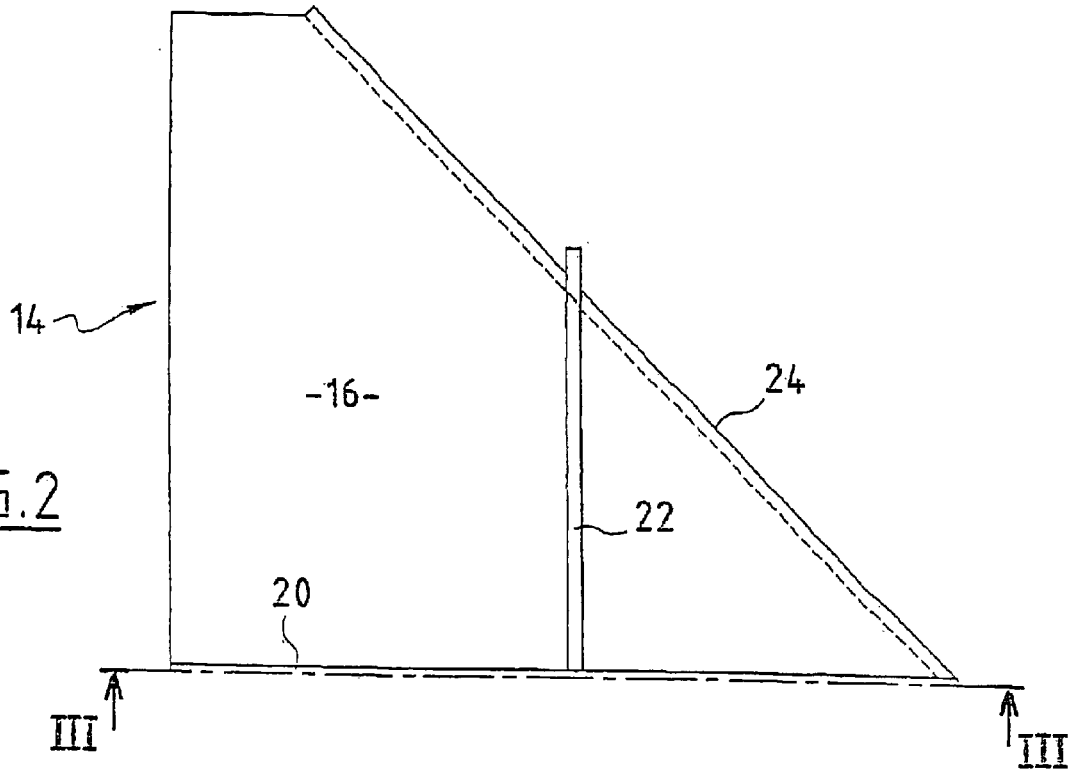
FIG. 2 is a fragmentary plan view of a kite belonging to the sail of the craft of FIG. 1.
Figure 3:
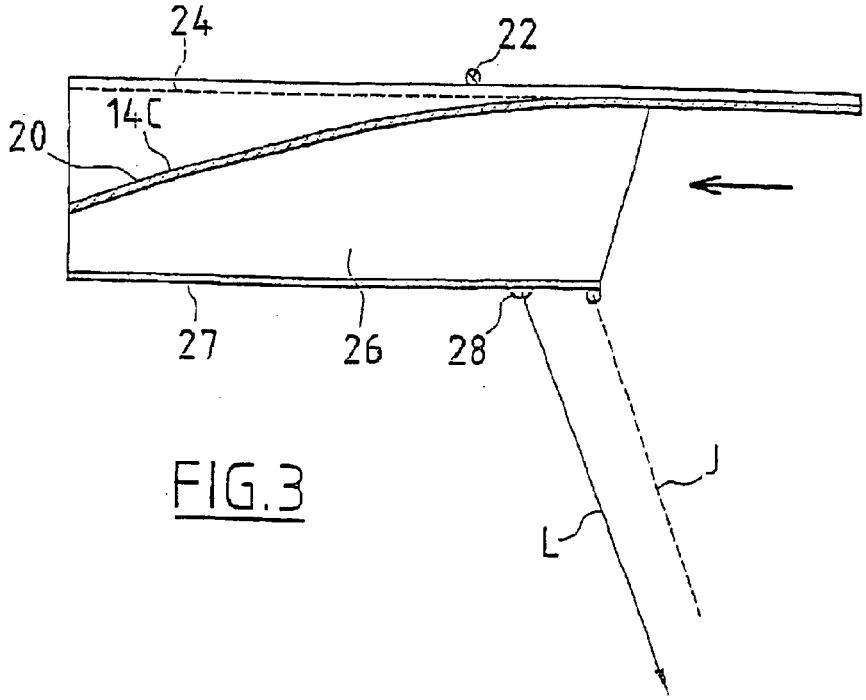
FIG. 3 is a section view on the plane III—III indicated in FIG. 2.

The auxiliary kite 14, referred to below as the "pilot kite", is a kite of the delta wing type, shown in detail in FIGS. 2 and 3. This kite 14 comprises a fabric sail 16 of substantially triangular shape and a framework made up of a very flexible axial pole 20 and a transverse batten 22 disposed perpendicularly to the pole 20 and interconnecting the two side edges of the wing. A respective side batten 24 is disposed on a portion of each side edge and is fixed to the transverse batten 22. The wing further comprises a central stabilizer fin 26, e.g. in the form of a triangle of fabric of V-shaped section disposed substantially perpendicular to plane of the sail 16. In the invention, the fin 26 is adapted to impart to the wing 14 a certain amount of curvature 14C that is more pronounced than the relatively small amount of curvature imparted to the wing by the framework alone, this being achieved by means of a rigid batten 27 placed at the base of the fin 14. The curvature 14C makes it possible to increase the traction of the sail 14 very significantly.

As shown in FIGS. 1A and 1B, the auxiliary kite 14 is connected to the leading edge 12A of the main kite 12 via the sheet L which is fastened to the kite 14 at a fastening 28 provided on the fin 26. Advantageously, in its portion connecting the auxiliary kite to the main kite 12, the sheet L is provided with a batten 30 oriented substantially parallel to the leading edge 12A of the kite 12 and connected to said leading edge 12A via two spaced-part points 31 and 32.

As shown in FIGS. 4 to 7, the rig 8 of the craft 1 further comprises:

a main base mast 40 that is short and built into the structure of the craft 1;

an auxiliary mast 42 situated in alignment with the main base mast 40; and a spar 44 provided on the bottom end portion of the auxiliary mast 42.

The auxiliary mast 42 is mounted to turn about the axis X-X of the main base mast 40 on the top end of said mast 40 via a swivel joint 46 shown diagrammatically in section in FIG. 10.

The spar 44 has an aft portion 44B which is mounted to pivot about an axis Y-Y substantially perpendicular to the axis X-X via a fork member (not shown in detail) enabling the spar 44 to rise or to fall, the free end of the spar travelling over a circle substantially centered on the fork coupling, above the water level. The spar 44 and the mast 42 are removable.

Since the spar 44 is designed to be pulled upwards by the sail 10, a downhaul stay 72 makes it possible to adjust the angular height of the spar relative to the craft 1.

In order to improve the stability of the sail under steady-state conditions, it can be useful to enable a forward portion 44A of the spar 44 to turn about the axis Z-Z of said spar by means of a suitable member 48, e.g. a swivel joint. On said front portion 44A, the rig 8 includes a clevis 49 connected to the craft via two side-haul control stays 50 and 52 whose respective anchor locations or anchor points 50A and 52A are situated in the vicinity of the freeboard portions of the craft. A plurality of anchor points may be provided. In particular, the points 50A, 52A may be situated on the external sides of the floating body (as shown in dashed lines in FIG. 6 only). It is also possible to envisage fixing projecting extensions to the body of the craft in order to provide the points 50A, 52A at the free ends of said extensions. A pulley or a block and tackle, also shown in dashed lines in FIG. 6 only, can then be disposed at the free end of the clevis 49 so as to facilitate controlling the stays 50 and 52.

The lengths of the stays 50 and 52 are adjustable so that, by reducing the length of stay 50, the spar is pulled to starboard by swinging about the axis X-X of the mast, whereas by reducing the length of stay 52, the spar is pulled to port.

The spar 44 includes all of the belaying and guide points for belaying and guiding the various sheets for controlling the sail 10 in the configurations shown in FIGS. 8A, 8B, 9A, 9B, and 9C.

Figure 9A:
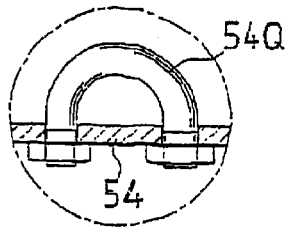
FIG. 9A is a section view of a ringed detail IXA of FIG. 8.
Figure 9B:
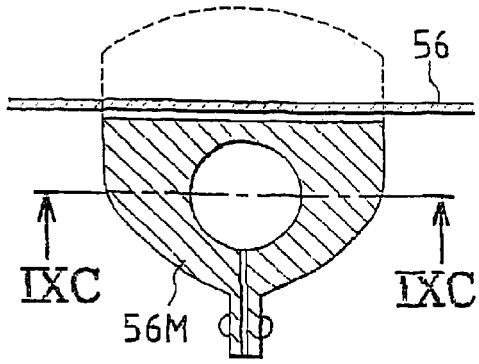
FIG. 9B is a section view of another ringed detail IXB of FIG. 8.
Figure 9C:
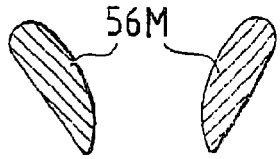
FIG. 9C is a section view on plane IXC—IXC of FIG. 9B.

For this purpose, the spar 44 is provided firstly with guide members 54M, 54P, 54Q, and 54L substantially in line on a plate 54 oriented transversely to the spar 44 and fixed on the portion 44B of the spar, and secondly with guide members 56M, 56P, and 56Q disposed at the end of the forward portion 44A of the spar, the members 56P and 56Q being disposed on a plate 56 oriented transversely to and fixed to the forward portion 44A of the spar, remote from and on either side of the axis Z-Z. Members 54M and 56M receive sheet M, members 54P and 56P receive sheet P, members 54A and 56Q receive sheet Q, and member 54L receives sheet L. Each of the guide members is adapted to make it easier for the corresponding sheet to slide and to make it possible to change the direction of the sheet. For example, each member is formed by a half-ring engaged into and secured to its respective support, as shown in FIGS. 9A, 9B, and 9C.

The spar 44 is also provided with a second transverse plate 58 secured to the portion 44B, and substantially analogous to the plate 54, but that supports cleats 58M, 58P, 58Q, and 58L adapted to jam the respective sheets M, P, Q, and L.

The rig 8 further comprises reels 60M, 60P, 60Q, and 60L associated with respective ones of the sheets M, P, Q, and L. The reels are mounted on a common drive shaft 62, and each of them is provided with a brake 64M, 64P, 64Q, and 64L adapted to transmit a certain amount of torque to the associated reel from the shaft 62. Each brake can be adjusted so that a "strong" brake imparts a large amount of torque between the shaft 62 and the corresponding reel, while a "weak" brake reduces the torque or even eliminates it completely. The shaft 62 is designed to be rotated by any suitable means. For example, such means may be constituted by an electric motor 6 via a non-reversible gear 68, or by a crank handle (not shown) at the end of the shaft. In which case, a ratchet wheel prevents the shaft from rotating in the unreeling direction.

In a variant (not shown) pulleys may be provided on the axis Y-Y of the spar 44 to deflect the sheets into a cabin in which the corresponding guides 54, cleats 58, and reels fixed to the auxiliary mast 42 are accessible.

The rig 8 further comprises other control members whose types and configurations appear more clearly from the following description of how the rig operates.

Figure 11:
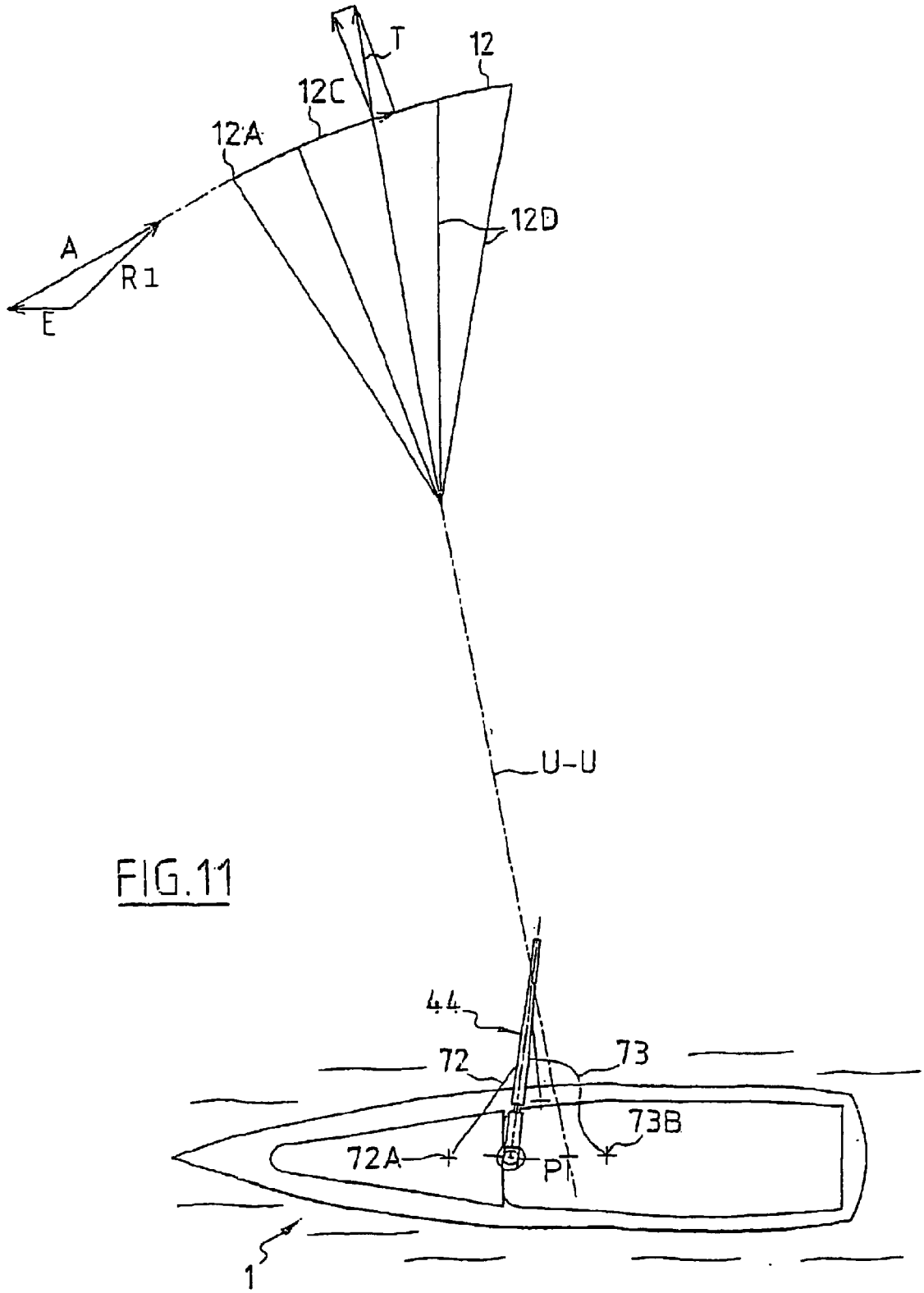
FIG. 11 is a plan view of the craft analogous to FIG. 5, showing an operating state of the rig when sailing close-hauled.
Figure 12C:
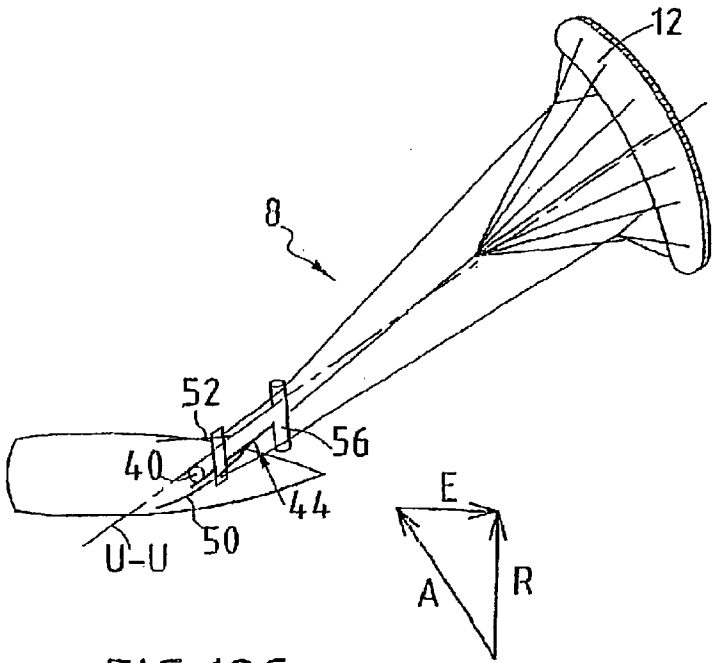
FIGS. 12A, 12B, and 12C are plan views that are substantially analogous to FIG. 4 but that are more diagrammatic, showing three states in the break-down of the movement of the craft while changing direction.
Figure 12B:
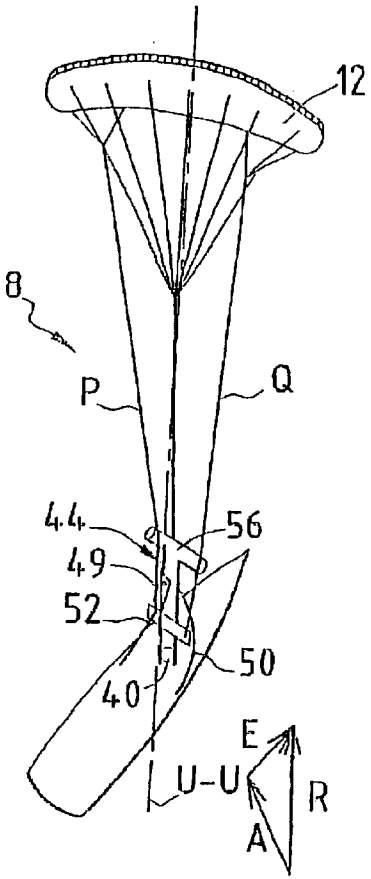
Figure 12A:
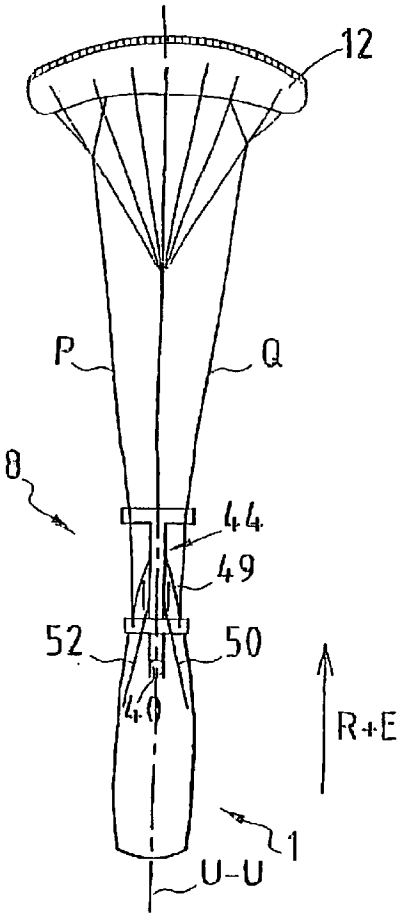

To illustrate operation of the above-mentioned craft of the invention, three different types of control operation are considered, namely launching the sail 10 (shown in FIGS. 10A and 10B), sailing close-hauled (shown in FIG. 11), and changing the direction of advance of the craft 1 (shown by FIGS. 12A, 12B, and 12C).

Figure 10A:
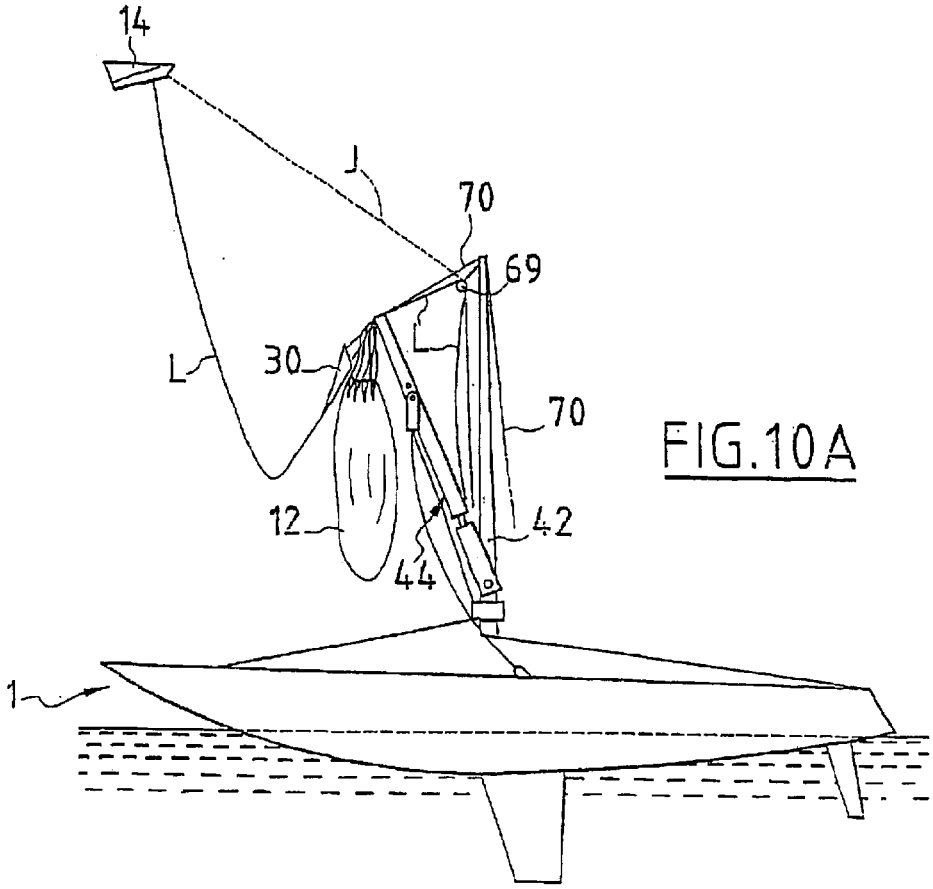
FIGS. 10A and 10B are side views analogous to FIG. 4, each of which shows a step in launching the sail.
Figure 10B:
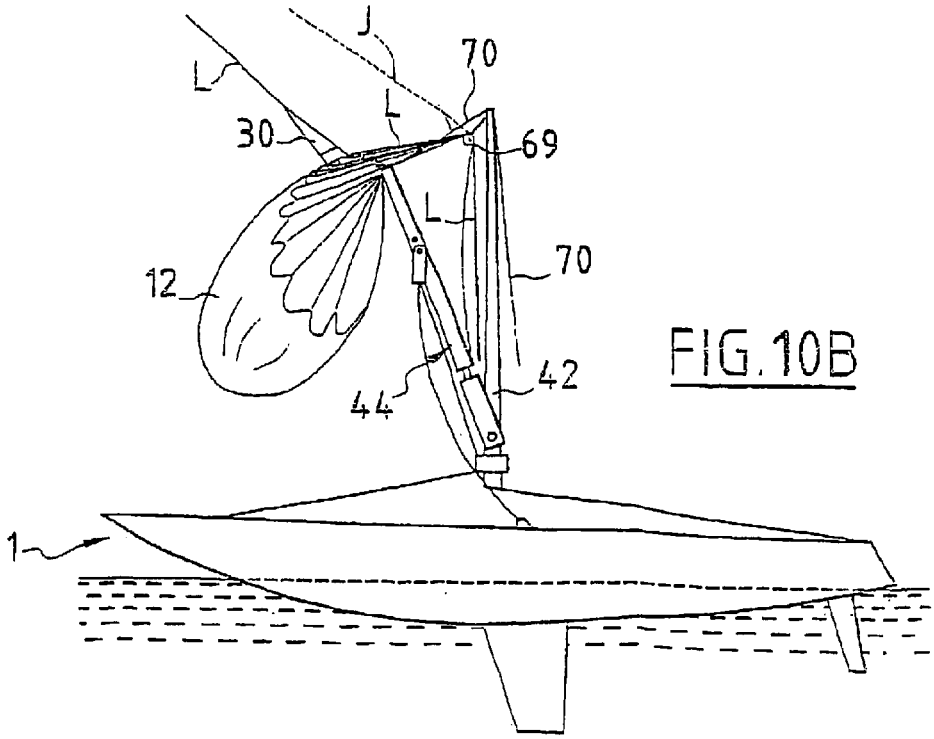

Launching a flexible airfoil such as a kite 12, whose span can exceed 15 meters, requires a particular technique. Firstly, it is necessary to launch the auxiliary kite 14: this operation is easy, since it is very easy to launch such a kite manually from the craft 1. The self-stabilizing capacity of the kite 14 is used to "pilot" deployment of the main kite 12. When the ascending force of the pilot kite 14 is greater than the weight of the main kite 12, launching is easy. Thus, after the pilot kite 14 has been launched, which kite stabilizes rapidly in the direction of the apparent wind, as shown in FIG. 10A, the launching sheet L controls progressive deployment of the canopy 12 and controls how it gains altitude. For this purpose, the brakes 64P and 64Q which are set to a value that is substantially zero on the sheets P and Q (i.e. the sheets P and Q unreel freely from their reels 60P, 60A), to a weak value on sheet M, thereby enabling the sheet M to unreel while remaining slightly under tension, and to a much higher value on the sheet L. Launching then takes place by acting only on the brake 64L of the reel 60L, which brake allows the canopy 12 to be deployed only provided that the tension of the sheet L reaches a value that is sufficient: the canopy 12 is then deployed and gains altitude without any action being required. During the launch stage, the pilot kite 14 not only provides a certain amount of ascending power, reinforced by the curvature 14C imparted by the pole 27 embedded in the fin 16 of the wing 14, but also provides lateral stability for the sail. For this purpose, the batten 30 placed at the leading edge 12A of the main airfoil 12 makes it possible to activate the central portion of the airfoil 12 as of the beginning of the launch, by giving additional ascending power.

Once the sail 10 is at the cruising altitude at which it enjoys strong and steady wind, the sheet M is cleated at the cleat 58M. Then the other sheets L, P, and Q are adjusted and cleated as a function of the chosen point of sailing, as described in more detail below.

It can be understood that the higher the ascending power of the pilot kite 14, the easier the launch, and therefore it is necessary, in particular in light winds, either to have a kite 14 that is of relatively large area, or else to have a train of a plurality of analogous or different airfoils as described in more detail below. In order to facilitate launching and to make it possible to reduce the size of the pilot kite 14, it is possible to envisage:

suspending the sheet L from the head of the auxiliary mast 42 via a pulley system 69 forming a guide member, and/or facilitating filling of the main kite 12 by suspending it beneath the spar 44 as placed in a high position by means of an up-haul stay or "topping lift" 70 whose length is adjustable and which connects the free end of the spar 44 to the top of the auxiliary mast 42; and/or enclosing the canopy 12 in a bag entrained by the pilot kite 14 and enabling the canopy to be released once the correct altitude is reached.

It is also possible, provided that the auxiliary mast is of sufficient length, to consider launching the steerable canopy 12 by means of the sheet L only, without using a pilot kite.

To bring the main kite canopy 12 back down, operation is substantially symmetrical to the launch operation: the brakes 64P and 64Q of the sheets P and Q are set to a low value making it possible to reel in the sheets P and Q under low tensions, the brake 64M applies slightly higher tension to the sheet M to guarantee stability for the canopy 12, and the brake 64L on the sheet L is set to its maximum value. Thus, after releasing the sheets from their cleats, rotating the shaft 62 of the reels by means of the gear 68 brings the kites 12 and 14 back down. Since the wind is spilled from the canopy 12, bringing it down is effortless.

When the canopy 12 comes into the vicinity of the craft 1, the sheets M, P, and Q being reeled in fully causes the canopy to fold back under the spar 44. In this last stage, it can be necessary to tension the top stay 70, as shown in FIG. 10A.

The kite 12 is then lowered onto the deck, by relaxing the top stay 70 so that it can be stored in a bag or in an individual bay (not shown) in the bows of the craft 1. It is then immediately available to be launched again.

Under cruising conditions, and on any given point of sailing, the rig of the invention is adjustable so that heeling is substantially totally eliminated. As explained above, the phenomenon of heeling is well known per se, and affects "traditional" sailboats because of the capsizing torque generated firstly by the lateral resistance R or "anti leeward drift reaction force" of the craft, and secondly by the capsizing component acting on the sail. It should be noted that the lateral resistance R of the craft is applied at a point of application known as the "center of lateral resistance" which is not fixed for all of the points of sailing, but which nevertheless belongs to a small substantially point-like zone of application referenced $P_i$ below and in the figures.

Figure 5:
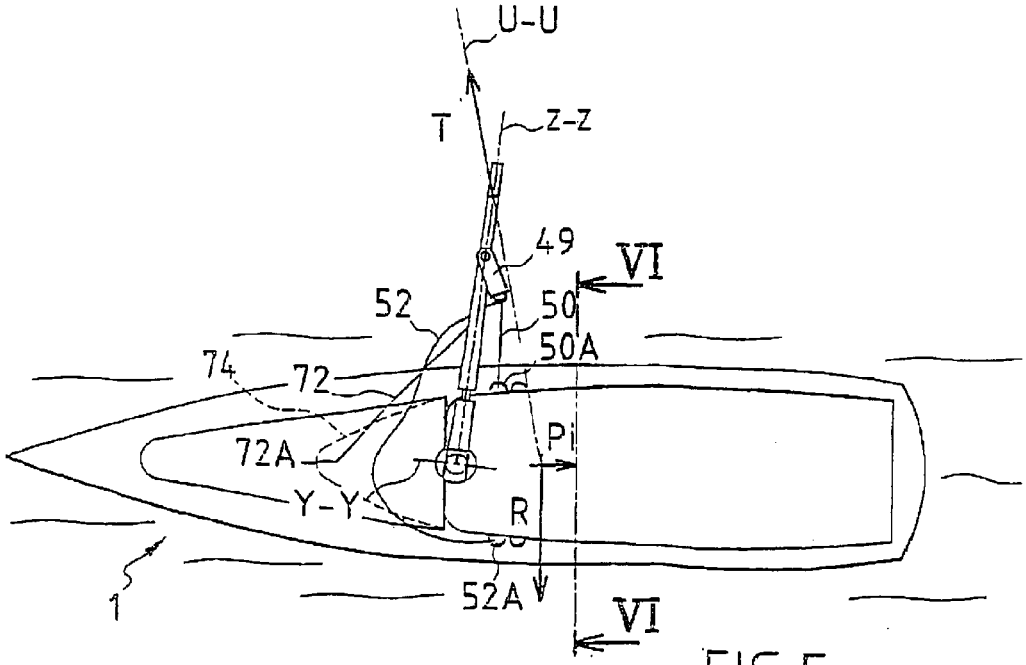
FIG. 5 is a plan view of the craft of FIG. 1 on substantially the same point of sailing as in FIG. 1.
Figure 6:
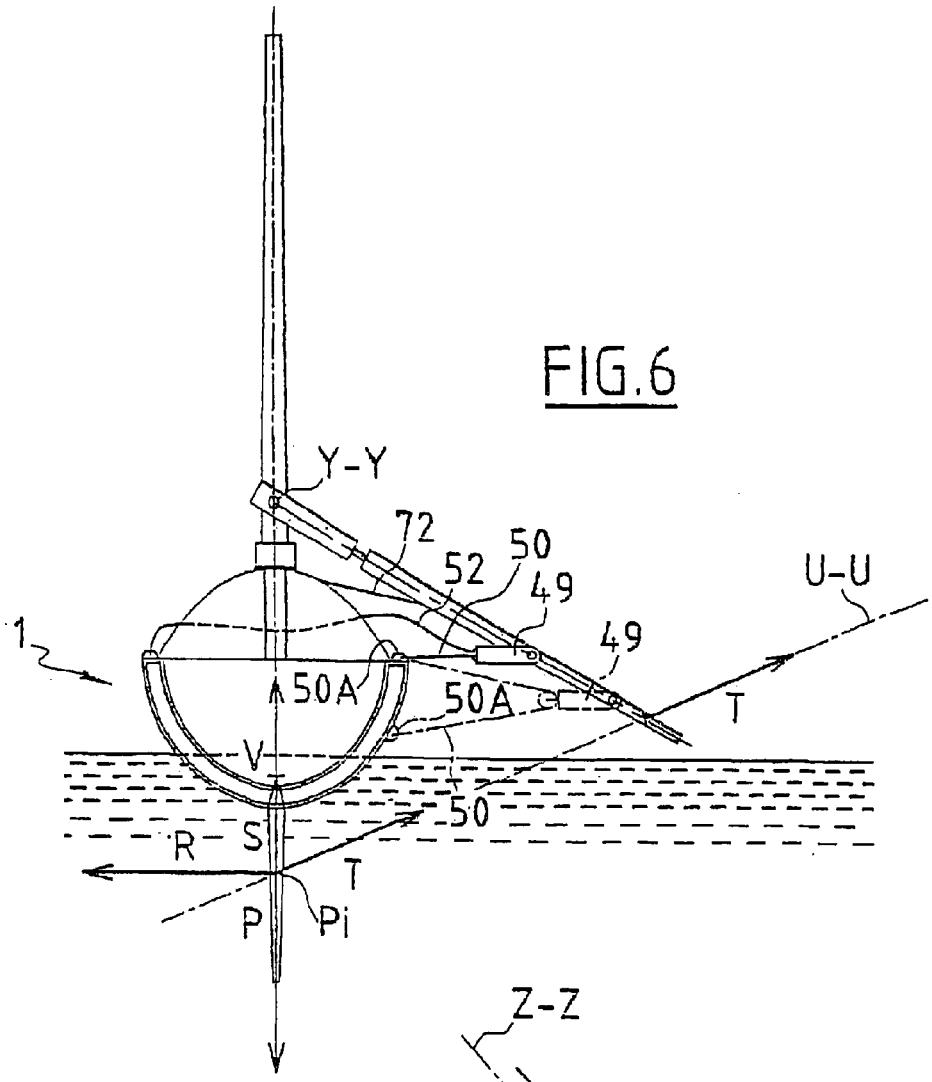
FIG. 6 is a section view on plane VI—VI of FIG. 5.
Figure 7:
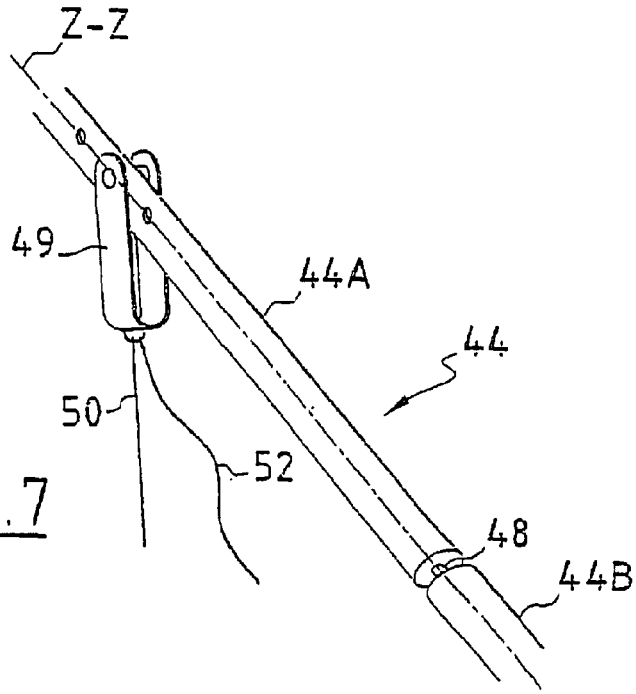
FIG. 7 is a perspective view showing a detail of the rig shown in FIG. 4.

Thus, for the craft 1 of the invention, when it is sailing close-hauled as shown in FIG. 11, for example, the kite canopy 12 is positioned by acting on the sheets P and Q, and by acting opposingly on the sheet L so that, on a section on the plane of the symmetry of the airfoil 12, its leading edge 12A is disposed substantially tangentially to the direction of the apparent wind A, which direction is a composition of the direction of the true wind R1 and of the direction of advance of the craft E, thereby making it possible to obtain a maximum traction force T. The force T is transmitted to the craft via the various sheets, via the shroud lines 12D. The sheet M transmits the largest fraction of said traction force, but the sheets P and Q can transmit fractions that vary depending on the point of sailing and while performing the control operations. Overall, by weighting the traction forces transmitted by each of the sheets connected to the craft at the corresponding through members, the canopy 12 defines a traction resultant T whose axis U-U is positioned relative to the craft 1 so as to pass substantially through the above-mentioned point $P_i$, thereby substantially eliminating heeling. With reference to FIGS. 11, 5, and 6 that show the craft on a substantially identical close-hauled point of sailing, said axis U-U extends from the kite 12 to under the craft by passing substantially through $P_i$, the traction resultant T not generating any capsizing torque with the hydrodynamic resistance of the craft 1. For the craft shown, the length of the spar 44 is sufficient to make it possible to obtain such positioning of the axis U-U relative to the point $P_i$, the guide member 56M of the main traction sheet M being situated outside the overall plan area of the craft on close-hauled and reaching points of sailing, the overall plan area of the craft being defined as the area lying within the maximum projecting outline of the floating body 2 on the surface of the water. On a different point of sailing, e.g. on a reach, the rig of the invention makes it possible to position the axis U-U of the traction resultant T so that, once again, heeling is substantially totally eliminated.

In spite of the fact that the height of the kite 12 above the horizon is different depending on the point of sailing (for example, the kite 12 forms an angle of in the range 40° to 75° with the horizon when running, and an angle of in the range 20° to 40° when close-hauled), adjusting the height of the spar 44 and/or its position relative to the longitudinal axis of the craft makes it possible to achieve the desired positioning of the axis U-U. This adjustment is performed via the side stays 50 or 52 and via the bottom stay 72.

To simplify this adjustment, it is possible to envisage choosing an anchor point 72A for anchoring the stay 72 forward of the mast 40 so that, without changing the setting of the stay 72, heeling remains below a chosen threshold when going from one point of sailing to another, the axis U-U of the traction resultant T passing at least in the vicinity of $P_i$. Under these conditions, it can be understood that turning the spar 44 relative to the auxiliary mast 42 by means of the clevis 49 automatically causes its height to adjust also.

It is also possible to lengthen or to shorten the bottom stay 72 if very precise adjustment of heeling is desired. It is also possible to envisage providing a plurality of possible longitudinal positions (along the axis of the craft) for the anchor potion 72A as a function of the kite canopy used. In a variant, the anchor point 72A may be mounted to move along a curved traveller bar provided with wheels and extending transversely above the deck of the craft, as shown in dashed lines in FIG. 5 only. Moving the point 72A along said bar makes it possible to reduce stresses and to obtain a more precise value for heeling, without modifying the length setting of the stay 72.

In addition, the anchor points 50A and 52A can be placed such that when close-hauled to sail upwind, the stay 72 no longer bears any traction. This makes it possible to change tack providing an additional stay 73 (shown slack in FIG. 11) is fitted that has an anchor point 73B situated aft of the point $P_i$ along the axis of the craft, and that is used during tacking.

In order to change the direction of advance of the craft 1, it is necessary to control the rig 8 in the following manner, as shown in FIGS. 12A, 12B, and 12C, FIG. 12A showing a craft 1 running before the wind. It should be noted that the figures show more a breakdown of the movements involved in the control operation, rather than a chronological breakdown.

Adjusting the side stays 50 and 52 causes the spar 44 to turn about the mast 40 and therefore generates a corresponding change of course for the craft (FIG. 12B). Via the clevis 49, the spar 44 is caused to turn about its own axis. The purpose of the spar turning about its own axis is to stabilize the lateral movement of the kite canopy 12 by accompanying the turning of the spar, e.g. over approximately in the range 70° to 80° clockwise for the spar on the port side on a close-hauled point of sailing, and conversely, so that the plate 56 of the through members 56P and 56Q remains substantially parallel to the long axis of the canopy 12.

In addition, differential adjustment of the sheets P and Q modifies the direction of the traction axis U-U of the kite canopy, thereby causing the kite 12 to turn about U-U, and thus causing it to move laterally relative to the apparent wind, thereby inducing an additional change of course (FIG. 12C).

Furthermore, it can thus be understood that a member of the rudder type is unnecessary insofar as, since the length of the spar 44 is sufficient, the traction resultant T exerted by the kite canopy 12 and the lateral resistance R of the craft impart the direction followed, as can be seen in FIG. 5. Conversely, if the craft has a rudder, since the height of the spar is set by the stay 72, it is possible to omit the side stays 50 and 52. The course of the craft is set by the rudder, and the lateral position of the spar is set by the traction from the sail 10. Heeling can be totally eliminated.

Once the direction of advance has been chosen, propulsion efficiency is optimized, depending on the point of sailing, by acting both on the two sheets P and Q, and also on the sheet L. By applying progressively increasing traction simultaneously to the sheets P and Q, the traction of the canopy 12 is increased to a very large extent; the height of the canopy above the horizon decreases until "stalling" occurs, and the canopy would fall into the water if it were not kept up by the auxiliary kite 14. The sheet L opposes the sheets P and Q: progressive traction on sheet L reduces the traction of the canopy 12, and, at least initially, increases the height of the canopy above the horizon, until the traction on the sheet M is reduced to zero. The sheet L is thus useful for limiting the traction in strong winds, and during the procedure for bringing down the main kite canopy 12.

Thus, when running, in order to obtain maximum traction, high tension is exerted on the sheets P and Q, but also on the sheet L so as to delay stalling. When sailing close-hauled, the tension on the sheets P and Q is quite low, and asymmetric tension on said sheets makes it possible to steer the sail relative to the wind.

Under cruising conditions, the sail 12 is stable without action being required of the helmsman, in terms both of height and of lateral position relative to the apparent wind, via the through members for passing the various sheets on the spar 44, which members are disposed so that any deviation from equilibrium automatically brings the sheet back to its point of equilibrium. Firstly, if, for example, the sail gains altitude, the sheets P and Q are tensioned (relative to the sheet M) while the sheet L relaxes, these two effects bringing the canopy 12 back to its original altitude (and vice versa). Secondly, if, for example, the sail is entrained to port, the sheet Q is tensioned, while the sheet P relaxes, these two effects bringing the canopy back to its initial position.

Because heeling is kept under control, it is possible to have a very large sail area without any risk of capsizing. The rig of the invention is simple and easy to control.

The craft of the invention also offers additional advantages.

A first advantage lies in the lightening of the weight of the craft, obtained by the sail 10. As shown in FIG. 6, the combination of the force components T and R generates a lightening force S which acts in the same direction as the buoyancy, referenced V in the diagram showing the breakdown of the forces in FIG. 6. This lightening S, supplemented by the structural lightening of the craft of the invention since anti-capsize members such as, for example, a ballasted keel, become unnecessary, offers a significant saving in weight and thus enables high speeds to be reached.

Figure 13:
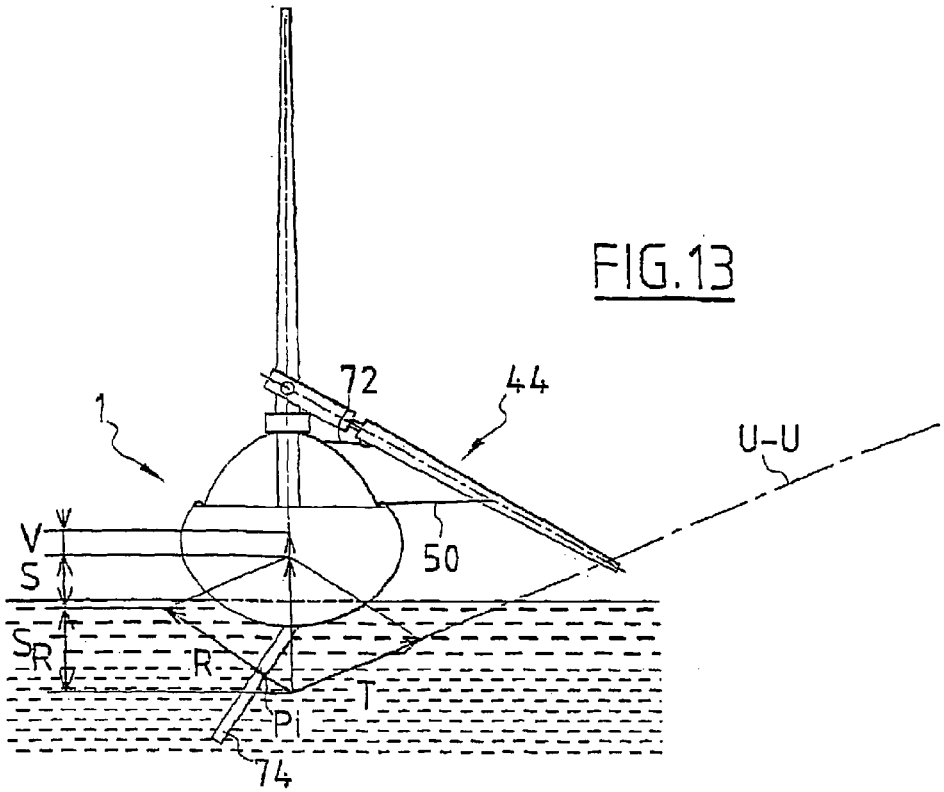
FIGS. 13, 14A, 14B, and 14C are views showing additional configurations for the craft of the invention shown in FIG. 1A, FIG. 13 being a view substantially analogous to FIG. 6, FIGS. 14A and 14C being side views, and FIG. 14B being a section view on the plane XIV—XIV indicated in FIG. 14A.

Since it is no longer necessary to provide high righting torque, since heeling is substantially zero, it is possible to consider reinforcing the lightening of the craft by replacing the fixed leeboard 4 with a tiltable leeboard 74 as shown in FIG. 13. The hydrodynamic lateral resistance R of the craft, mainly determined by the central leeboard of the craft, is then directed upwards and generates an additional lightening component $S_R$. For this purpose, the leeboard 74 should be tilted towards that side of the craft which is opposite from the side on which the spar 44 is disposed, which spar should be lengthened because of the offset of $P_i$ due to the tilt of the leeboard.

Figure 14A:
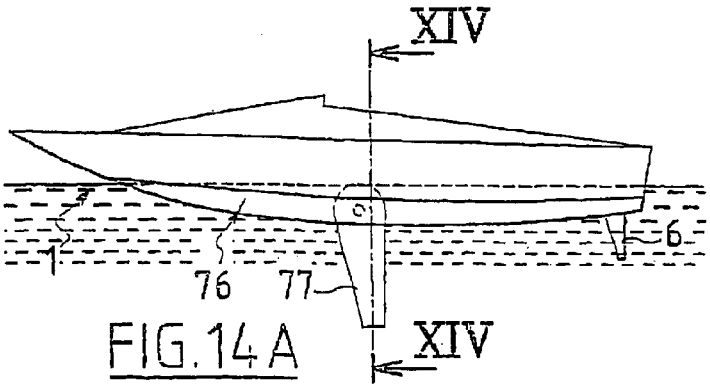
Figure 14B:
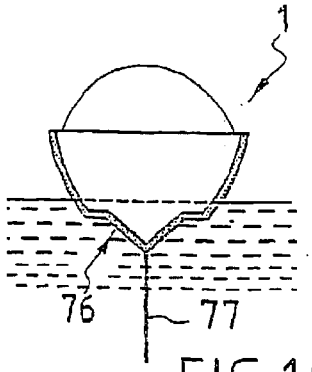

Similarly, the shape of the floating body 2 of the craft is easy to optimize in order to reduce its hydrodynamic drag. As shown in FIGS. 14A and 14B, it is also possible to implement a planing hull 76 making planing possible.

Figure 14C:
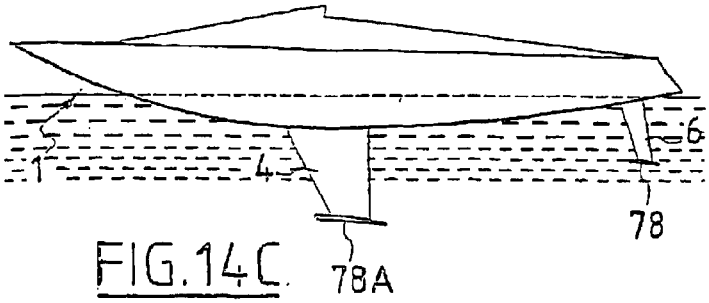

Advantageously, it is possible to provide foils on the leeboards 4 and 6 in order to obtain a further reduction in the drag of the floating body. By placing a fixed foil 78A on the main leeboard 4, and a steerable foil 78B on the aft leeboard 6 as shown in FIG. 14C, the longitudinal balance of the craft is guaranteed while also benefiting from the lightening due to the foil in addition to the lightening due to the sail.

In a variant (not shown), the central leeboard may advantageously be replaced by two side leeboards, making it possible to reduce the depth under the water of the point $P_i$.

Thus, by eliminating heeling, the speed reached by a craft of the invention advantageously combined with one of the above-mentioned configurations is very high.

In addition, the risks of damaging the rig are limited. The forces to which the craft is subjected remain concentrated in a small zone situated at the center of the craft, which enables it to be dimensioned accordingly. The stay-anchoring locations 50A and 52A, and the plate 58 carrying the cleats must be capable of withstanding large traction forces. The central leeboard 4 is subjected to forces of the same order of magnitude. The remainder of the rig is not subjected to large forces: the non-stayed auxiliary mast 42 is subjected only to limited forces due to the sheet L, and the spar 44, which is of limited length (approximately in the range 2 meters to 5 meters), works in bending as a function of the anchor locations of the side stays 50 and 52 and of the bottom stay 72.

Figure 8A:
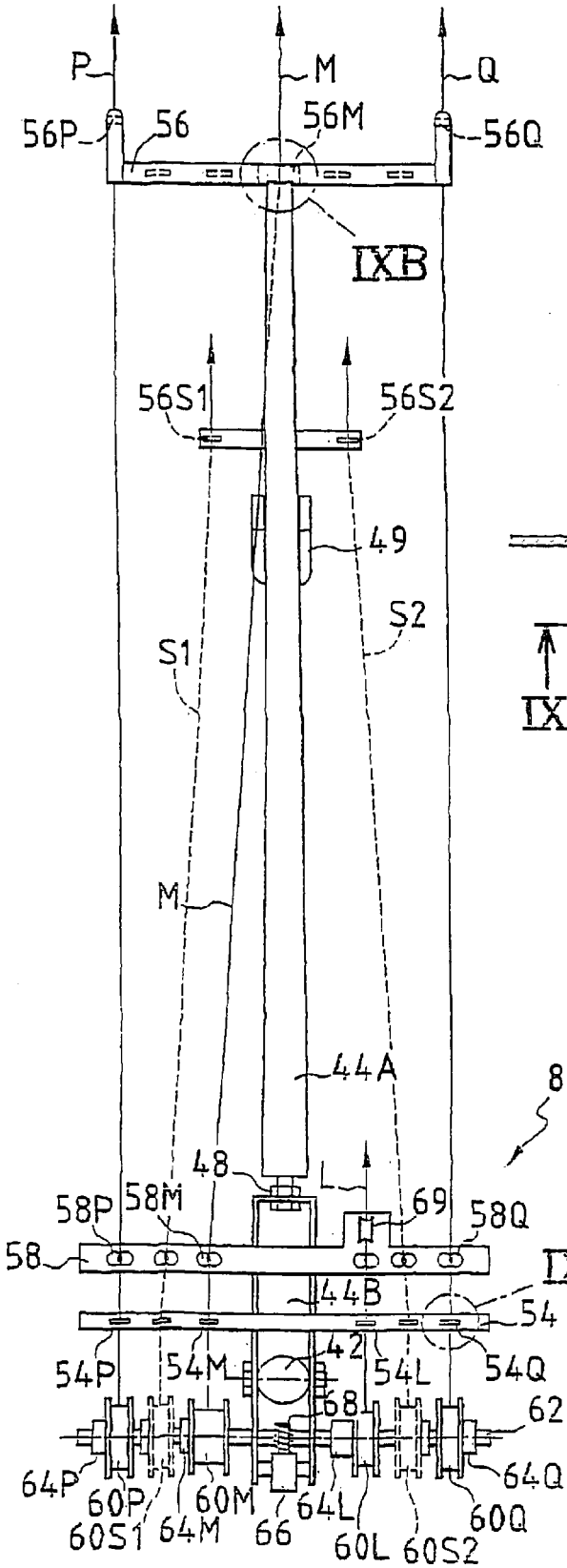
FIGS. 8A and 8B are more detailed views of the element of FIG. 7, FIG. 8A being a plan view and FIG. 8B being a side view.
Figure 8B:
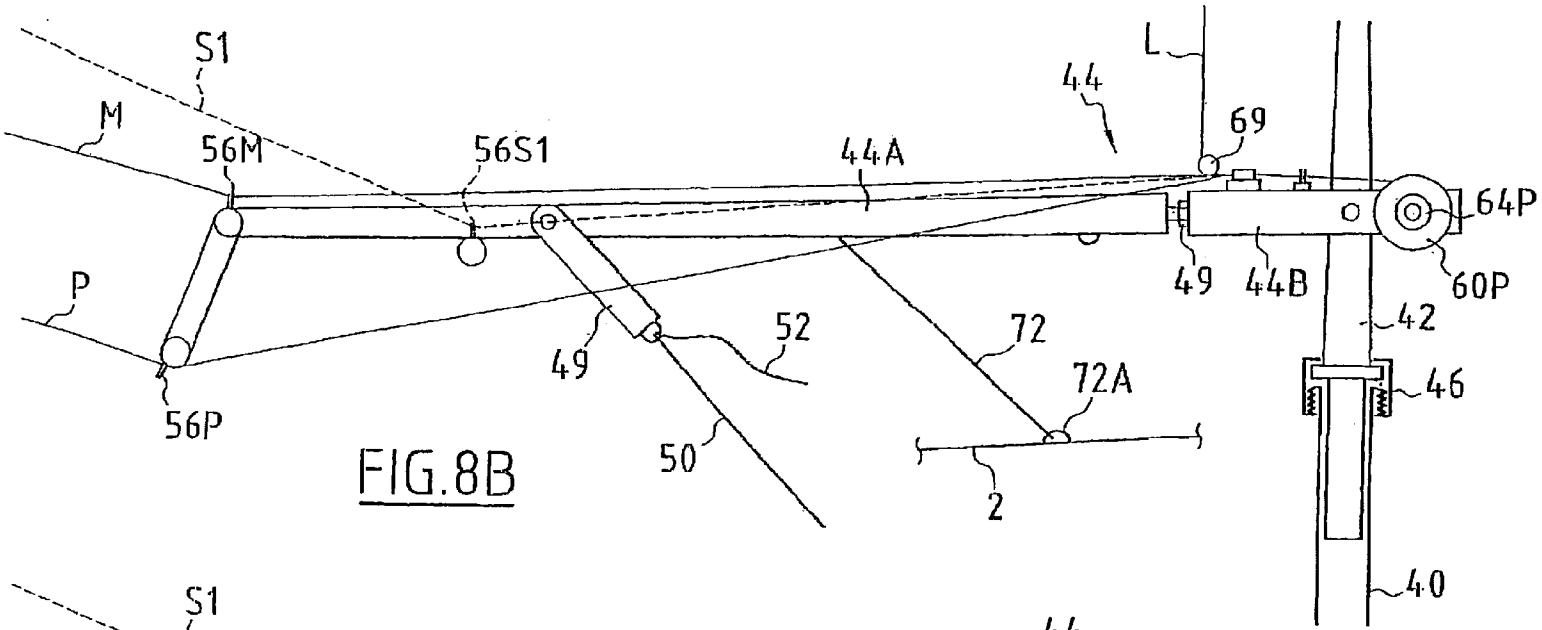
Figure 8C:
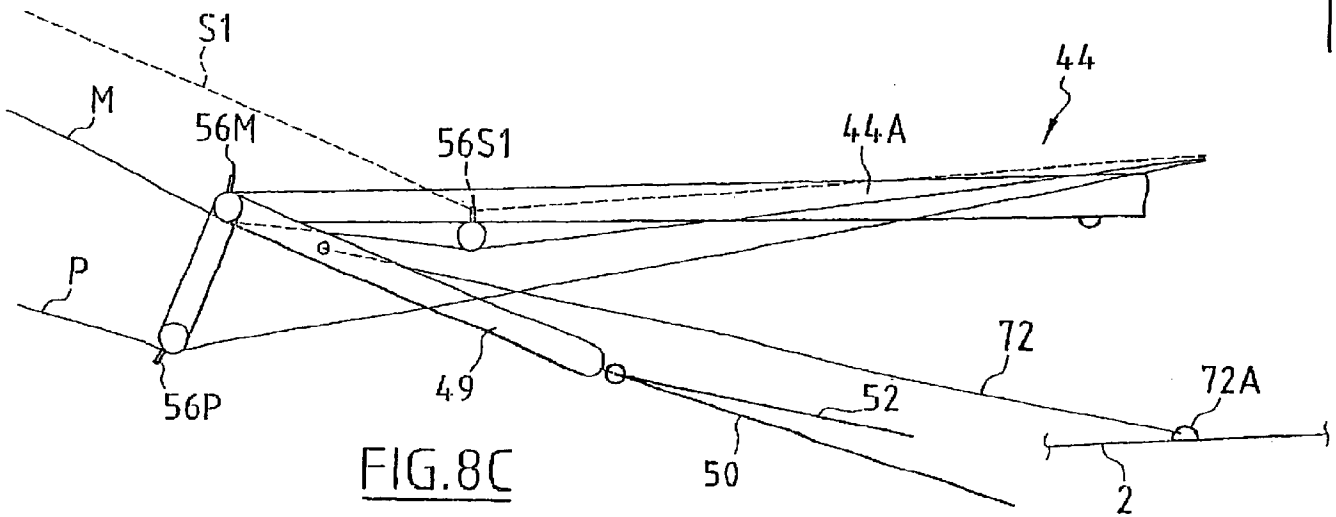
FIG. 8C is a view analogous to the view of FIG. 8B, showing a variant of the rig of the invention.

In order to prevent the spar from working over-intensely in bending, the anchor points of the side stays 50 and 52, and of the bottom stay 72 are situated at the end of the spar 44, as shown in detail in the variant of FIG. 8C. More precisely, for this variant, the fastening end of the stay 72 is fixed to the running portion of the clevis 49, and the clevis 49 is fixed to the forward end of the forward portion 44A of the spar 44, the main traction sheet M then passing inside the branches of the clevis 49. The spar 44 is then subjected substantially only to longitudinal stresses, along its axis Z-Z.

Finally, another advantage of the craft of the invention lies in the possibility of sailing the craft by computer. The entire traction force T of the sail 10 can be measured exactly by a force gauge disposed on the plate 58 carrying the cleats. It is even possible to place a force gauge on each cleat in order determine the traction of each sheet individually, which makes it possible to optimize the traction of the main kite canopy 12 as a function of the tension on the sheets P and Q, and on the sheet L. During launching, it is possible to verify whether the traction on the sheet L is sufficient to raise the main kite canopy. Finally, in a light wind, an alarm can indicate that the traction on the sheet M has fallen to below a given threshold, a second threshold giving the order to bring down the canopy 12.

It is also possible to measure the angular co-ordinates of the traction via the sheet M. When the direction and the speed of the apparent wind A are known, it is possible to envisage inputting into a suitable control unit all of the parameters for trimming the rig 8. Sailing the craft by computer then requires servo-motors disposed on the trimming sheets P and Q. Similarly, automatically bringing down the sail in the event of lack of wind may naturally be envisaged.

Figure 15:
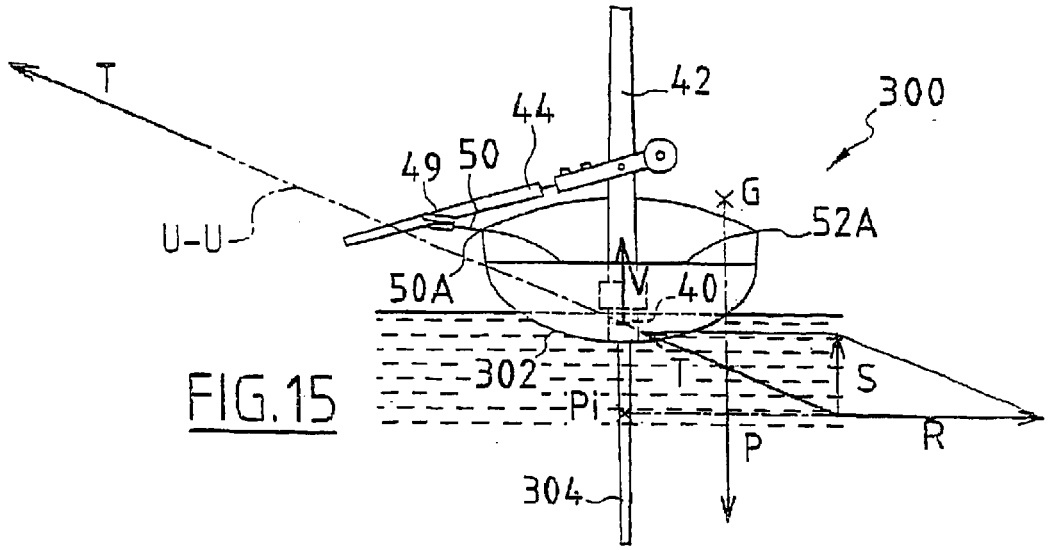
FIG. 15 is a view from astern of an open dinghy in which moveable masses play an important part in controlling heeling.

FIG. 15 shows a small sailboat 300 rigged according to the invention. This sailboat belongs to a category of lightweight craft on which movement of the crew or more generally of moveable masses plays an important part in heeling, and on which the rig of the invention is not designed to eliminate heeling totally, but rather to lower it to a chosen threshold, the final correction of the heeling being achieved by the positioning of the crew and by the control operations they perform, in particular when sailing close-hauled.

Figure 4:
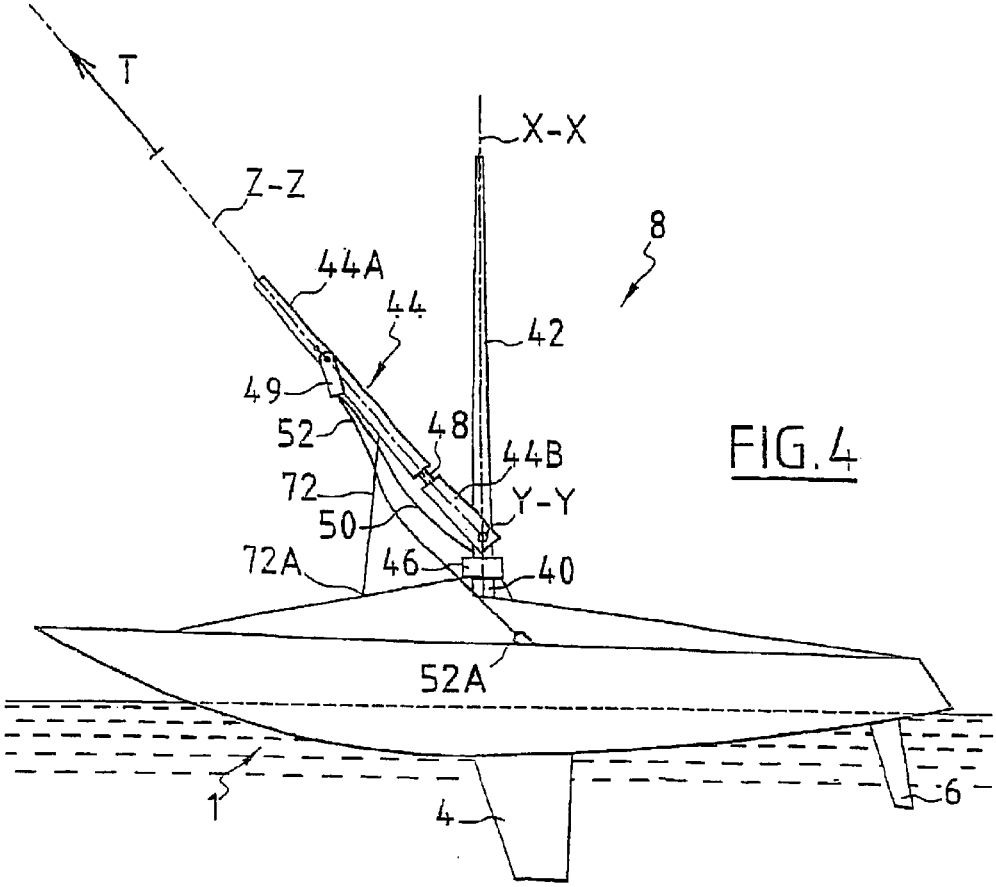
FIG. 4 is a fragmentary side view of the craft of FIG. 1, but shown running before the wind.

To this end, in addition to the elements it has in common with the craft 1 shown in FIG. 4 and that are given the same references, the craft 300 includes a open floating body 302 provided with a leeboard 304. it also has a rig 306 including a sail 10 (not shown). The rig 306 is substantially analogous to the rig of the craft 1 of FIG. 4, with the following differences. The main base mast 40 is limited to a height of a few tens of centimeters.

Adjusting the stays 50, 52, and 72 makes it possible to lower the heeling to a desired threshold. As shown in FIG. 15, the traction resultant T exerted by the sail does not pass through the point $P_i$, but rather slightly thereabove. The combination of the lightening S and of the buoyancy V opposes in terms both of direction and of value the weight of the sailboat crew (whose center of gravity G is indicated); the combinations of the resulting forces makes it possible to obtain heeling that is substantially zero.

The above-described rigging configurations are applicable to other craft on which movement of moveable masses is to be taken into consideration. Thus, in the invention, any craft may be rigged with a rig similar to the rig 8, including the smallest and most unstable of craft. For example, canoes, kayaks, sailboards, craft derived from the jet-ski, lightweight sailing dinghies, beach catamarans, inflatables, etc. According to the invention, larger vessels can receive this rig, such as ocean cruising yachts, multi-hulled yachts, and motor launches, this list not being limiting. According to the invention, it is possible to stow this rig in the hold in order to use it as an emergency sail in the event of engine failure or of dismasting, or more simply while motor cruising.

Figure 16A:
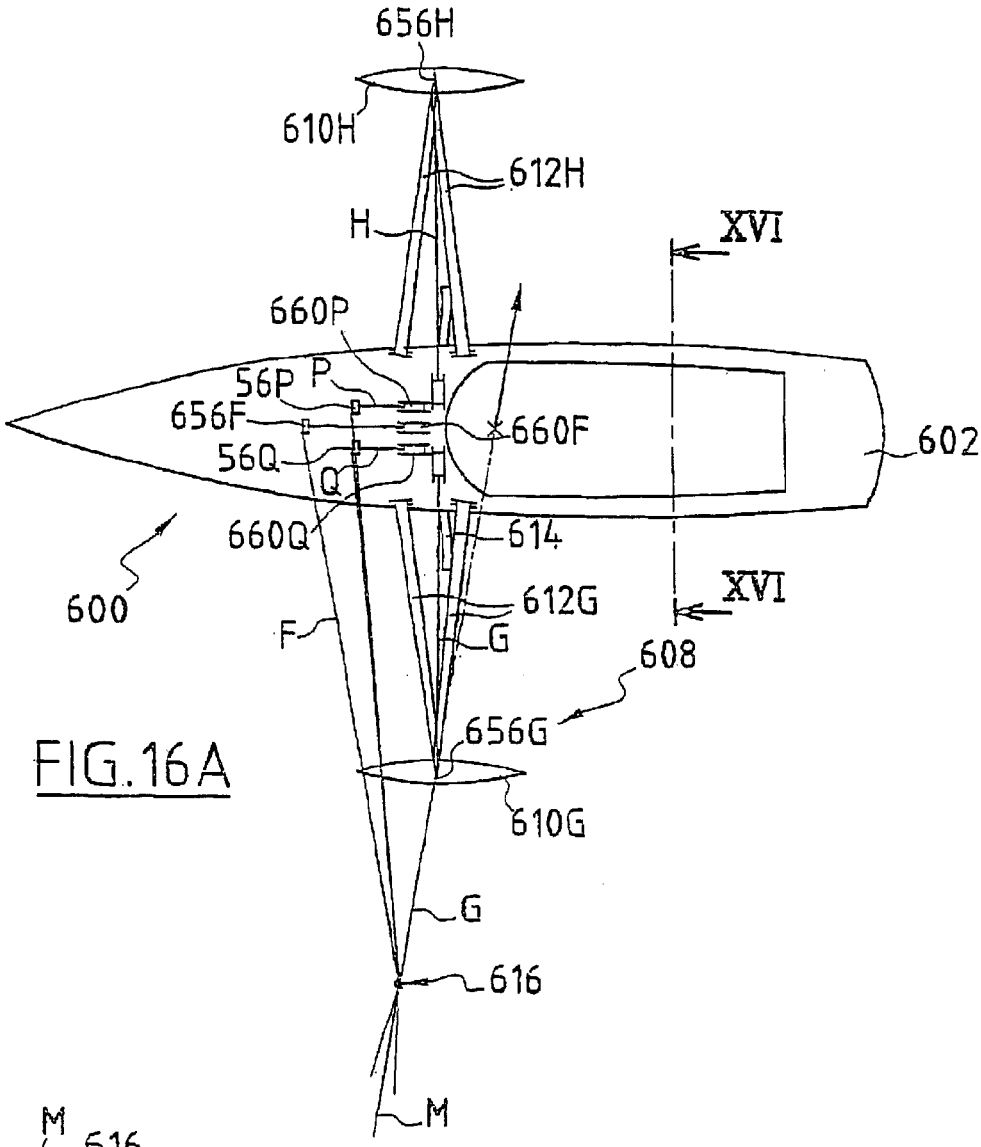
FIG. 16A is a view analogous to FIG. 5, but showing a second embodiment of the invention.
Figure 16B:
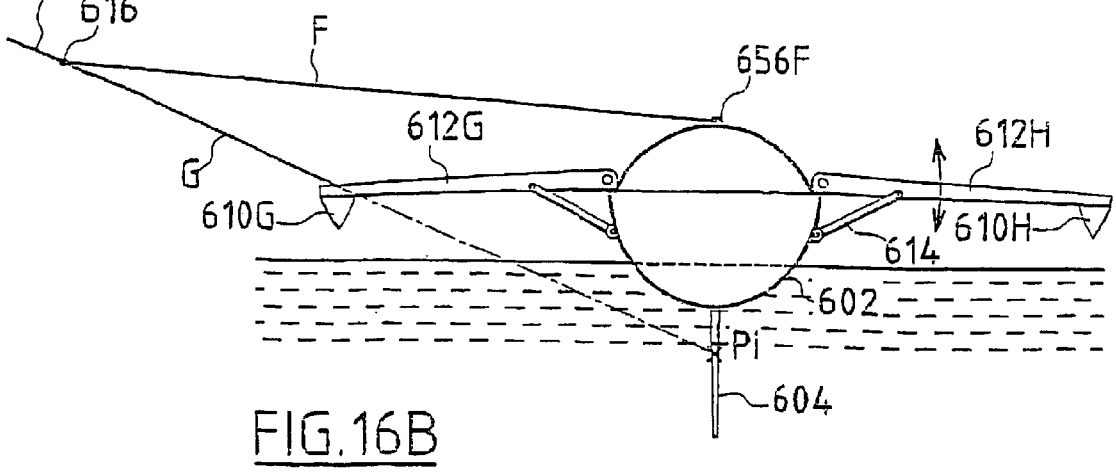
FIG. 16B is a section view on the plane XVI—XVI indicated in FIG. 16A.

FIGS. 16A, 16B, 17A, and 17B show a second embodiment of the craft, applicable to craft that are substantially of the same type as the craft shown in FIG. 4. As shown in FIGS. 16A and 16B, a craft 600 of the above-mentioned type and of the invention has a rig 608 that is significantly different from those described above, except for its sail 10 which is not reproduced on these figures, and which comprises a main kite canopy 12 and optionally a pilot kite 14.

The craft 600 comprises a floating body 602 provided with two leeboards 604 and 606 substantially analogous to the leeboards 4 and 6 of the craft shown in FIG. 4.

That end of the sheet M of the rig 608 which is connected to the craft is made up of three traction lines:

a line F passing through a guide member 656F disposed on the foredeck of the craft, forward of the point $P_i$, and on the longitudinal axis of the craft; and two lines G and H passing through respective guide members 656G and 656H disposed on either side of the midplane of the craft.

The guide members 656G and 656H are disposed at the outer ends of respective support arms 612G and 612H connected to the body 602, supported by actuators 614, and provided with optional outrigger floats 610G and 610H that are of small size.

The lines F, G, and H are connected together at a convergence zone 616 from which the sheet M retains its single-line configuration up to the shroud lines of the canopy 12. The directional sheets P and Q are organized to slide through this convergence zone 616. The guide members 56P and 56Q for guiding the sheets P and Q are disposed substantially on the deck of the craft, on either side of the midplane of the craft.

The rig 608 has a reel 660F for the line F, and reels 660P and 660Q that operate analogously to the reels 60P and 60Q of the rig 8 shown in FIGS. 8A and 8B.

The craft 660 operates substantially identically to the craft shown in FIG. 4, as described below.

Although not shown, the rig 608 is provided with means substantially analogous to those making up the rig of FIGS. 8A and 8B adapted to launching the sail 10 and to bringing it down, in particular via the launching sheet L. If necessary, an auxiliary mast 642 may be located in the zone within which the sheet L is anchored, for the purpose of facilitating launching the sail and bringing it down.

Depending on the point of sailing, the traction force exerted by the sail 10 is developed mainly on one of the three lines F, G, or H. Thus, when the craft is running, the line F bears most of this force, whereas when the craft is close-hauled, the line G or the line H bears most of it, the line G being tensioned and the line H being slack for a wind coming from the starboard beam, for example (as shown in FIG. 16B).

The axis U-U of the traction resultant T generated in this way participates in force-balancing that is substantially analogous to the force-balancing described in FIGS. 4 and 6, said axis U-U passing substantially through $P_i$. Heeling is thus eliminated.

In addition, traction on the line G moves the kite canopy 12 to port, since the line H is slack, and the line F remains at a constant length. Therefore, the course of the craft 600 is imparted by the same effect as that described above. Once the desired setting is obtained, the craft 600 holds a constant direction relative to the wind, without it being necessary to have a rudder.

Advantageously, the actuators 614 are used in harbor to raise the support arms 612G and 612H to the vertical and/or for finely adjusting the desired heeling threshold by slightly offsetting the axis U-U of the traction resultant.

Figure 17A:
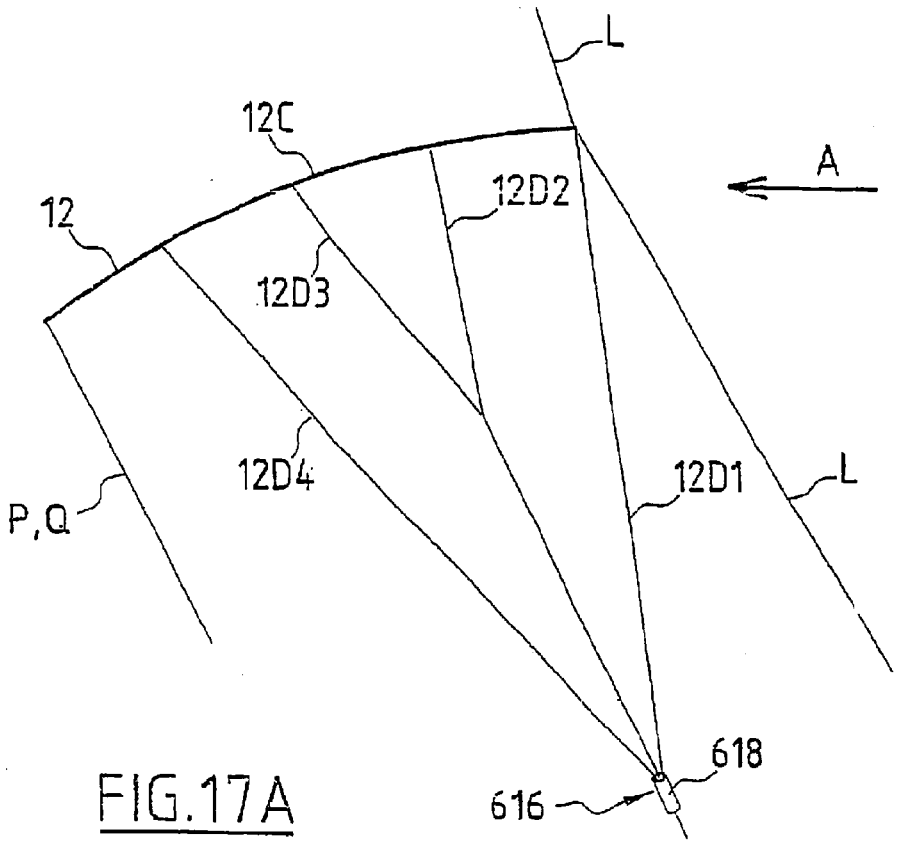
FIGS. 17A and 17B are diagrammatic section views on the axial plane of a portion of the sail of the craft of FIG. 16A.
Figure 17B:
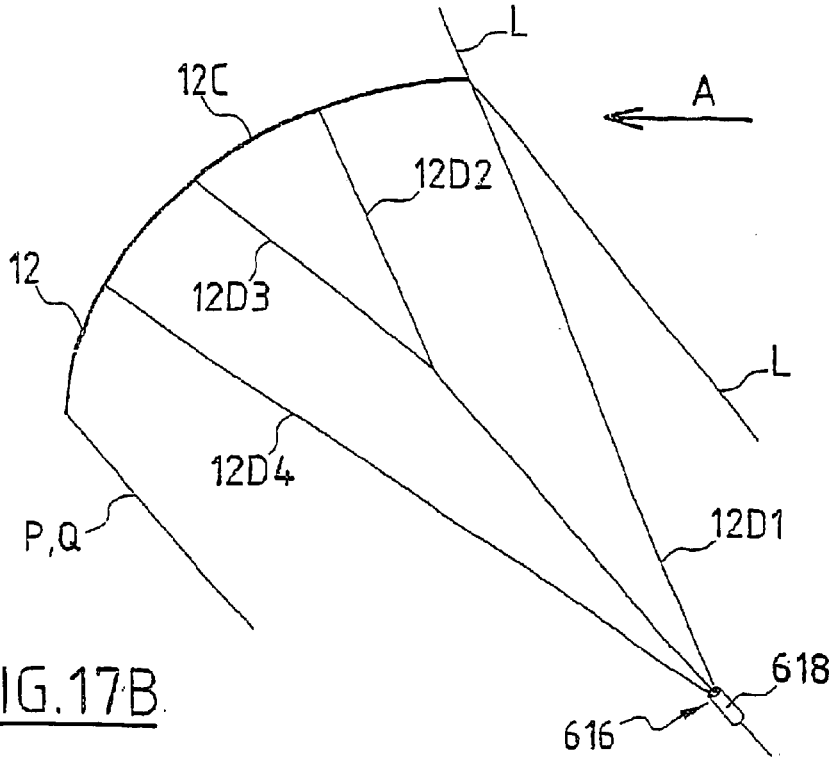

An additional advantage of this embodiment lies in the variation induced in the curvature 12C of the kite canopy 12. It is observed that, when the canopy 12 is running, i.e. when the traction is exerted essentially via the line F, the curvature 12C must be increased. Conversely, when the canopy 12 is close-hauled, i.e. when the traction is exerted essentially via the line G or via the line H, said curvature must be reduced. Thus, the coupling zone 616 may advantageously be provided with a device 618 for transmitting traction selectively depending on the point of sailing. FIGS. 17A and 17B are detail views showing certain shroud lines 12D of the canopy 12, referenced 12D1, 12D2, 12D3, and 12D4, and contained in the plane of symmetry of said canopy. On a close-hauled point of sailing (apparent wind referenced A), the device 618 makes it possible for traction to be exerted to a greater extent on the shroud lines 12D1 and 12D4 by the line G or by the line H, thereby reducing the curvature 12C, whereas, on a run, the device makes it possible for traction to be exerted on the shroud lines 12D2 and 12D3 via the line F, thereby increasing the curvature of the canopy 12.

Another advantage of this embodiment lies in the possibility of servo-controlling the variation of the lateral movement of the canopy 12. It is observed that, when the traction is exerted essentially via the line G or via the line H, the canopy 12 must be swung towards the bow of the craft, i.e. either to the right or to the left of the path of the wind depending on the sheet used. The rig 608 may therefore include a member for servo-controlling the lateral movement of the canopy 12, which member is controlled by the progressively increasing variation in the traction for the line G or the line H, while said traction decreases for the line F.

The above-described second embodiment of the invention is applicable to various types of craft. Examples are described below, the elements the crafts have in common with the craft 600 bearing the same references.

Figure 18A:
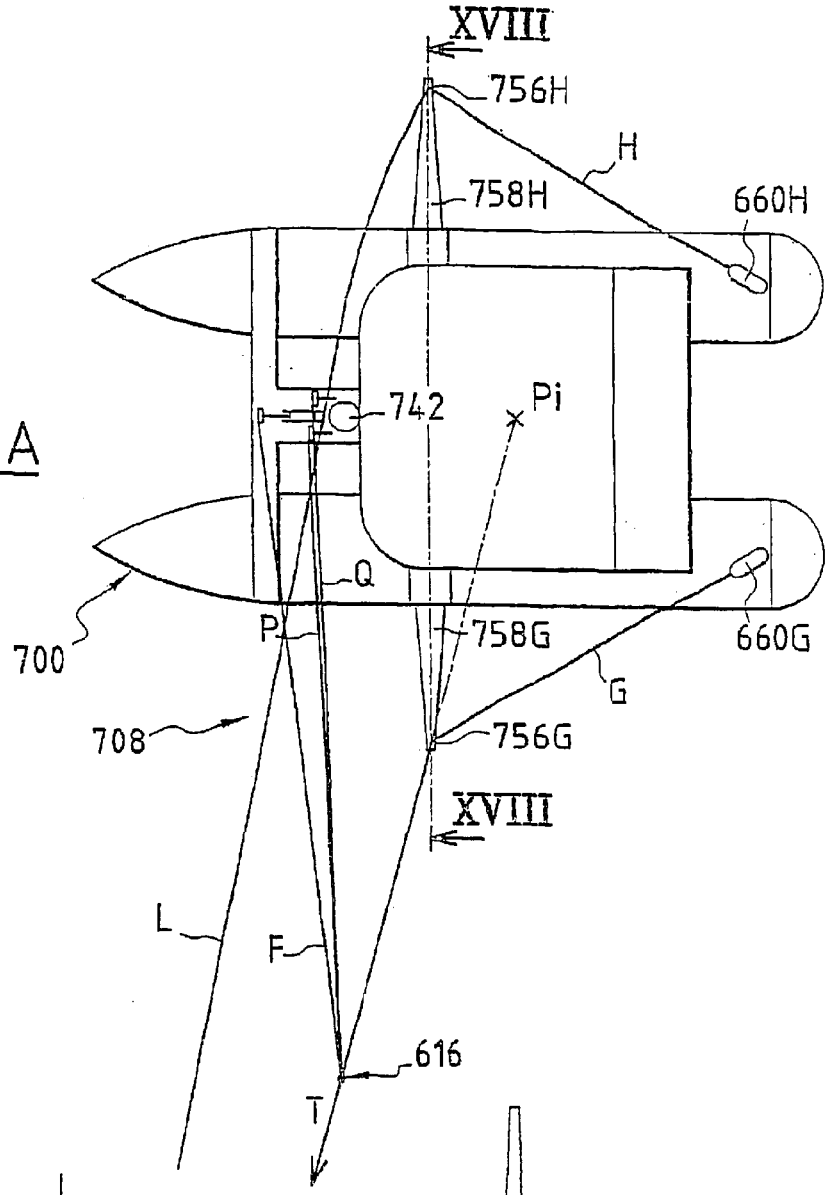
FIGS. 18A and 18B are views showing the use of the second embodiment of the invention on a type of craft other than a single-hulled craft, FIG. 18A being substantially analogous to FIG. 16A, and FIG. 18B being a section view on plane XVIII—XVIII of FIG. 18A.
Figure 18B:
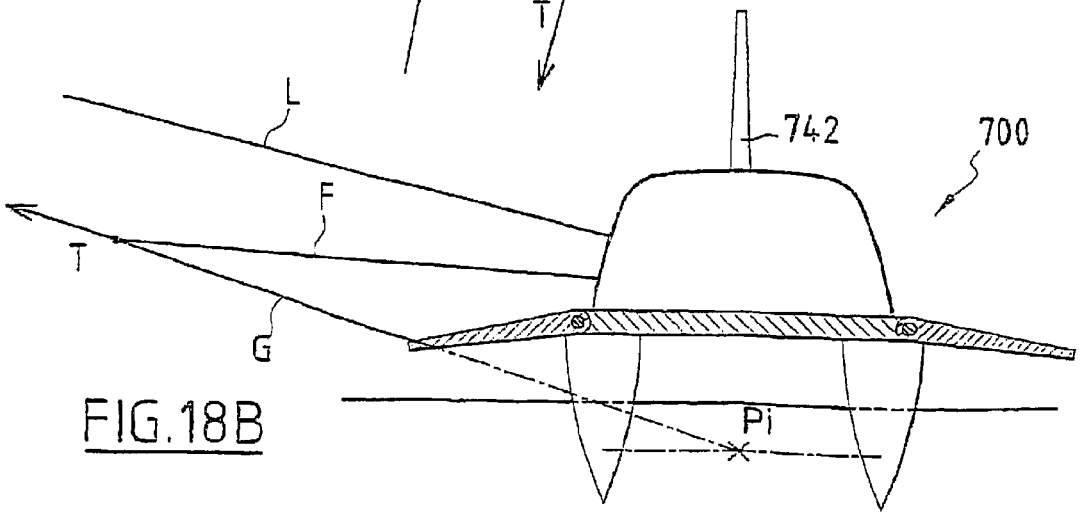

FIGS. 18A and 18B show a first example concerning the field of multi-hulled craft. The rig 708 of a catamaran 700 is configured according to the invention. Guide members 756G and 756H are positioned on outrigger-forming extensions 758G and 758 on either side of the cross-beams for coupling together the hulls of the catamaran, it being possible for the extensions to be dismounted or re-mounted in the harbor. The rig 708 includes a launching mast 742.

Figure 19:
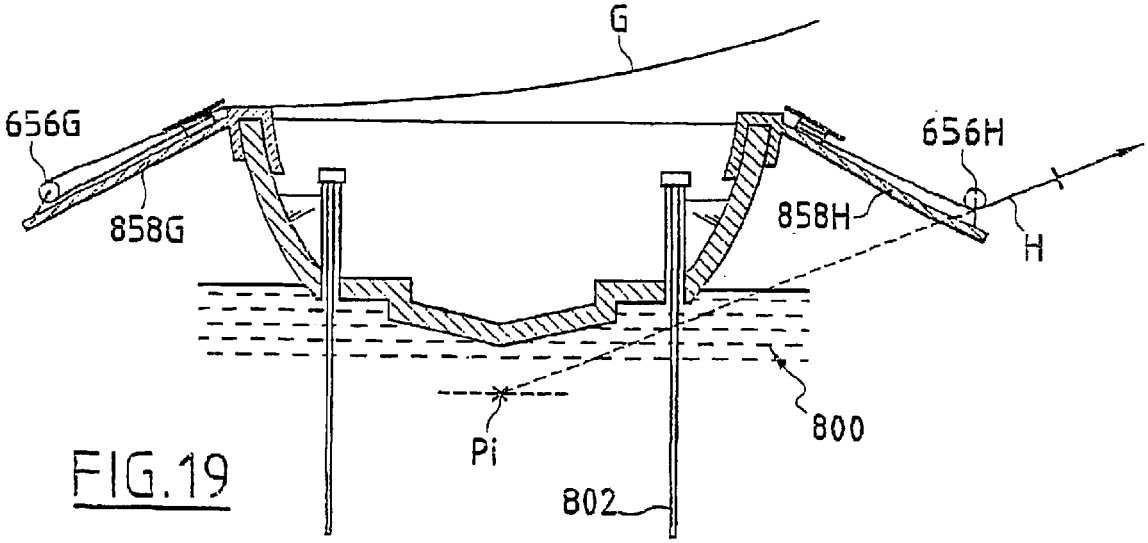
FIG. 19 is a view substantially analogous to FIG. 16B but for another type of craft.

FIG. 19 very diagrammatically shows a motor boat 800. On such a craft, when the priority is comfortable cruising when the wind is favorable, rather than performance, guide members 656G and 656H are placed on quite short support arms 858G and 858H, slightly above the waterline. For sailing close-hauled, it is also necessary to provide sheets P and Q, on condition that the boat has two effective leeboards on respective sides. These leeboards may advantageously be retractable so that they are removed when the craft 800 is being propelled by the engine.

It is possible to simplify the rig 608 on open sailboats, sailboards, or beach catamarans when the moveable masses are large compared with the mass of the craft because the axis U-U of the traction resultant of the sail can pass significantly above the point $P_i$, the final balance being obtained by the crew moving. For example, for a craft which has a floating body constituted by an open hull equipped with a leeboard and with a rudder, and whose sail is analogous to the sail shown in FIG. 1, it is possible to omit the sheets G and H of the rig 608 by passing the sheet M directly through a guide situated on the axis of the craft, slightly above the waterline. However, total correction of heeling can be obtained only if the traction from the sail is lower than a predetermined threshold.

Finally, it should be noted that all of the examples described in detail above are based on a sail 10 made up of a main kite 12 of the parafoil type, and of a pilot kite 14 of the delta wing type. However, numerous configurations and variants of kite sails may be envisaged without going beyond the ambit of the invention.

Figure 20A:
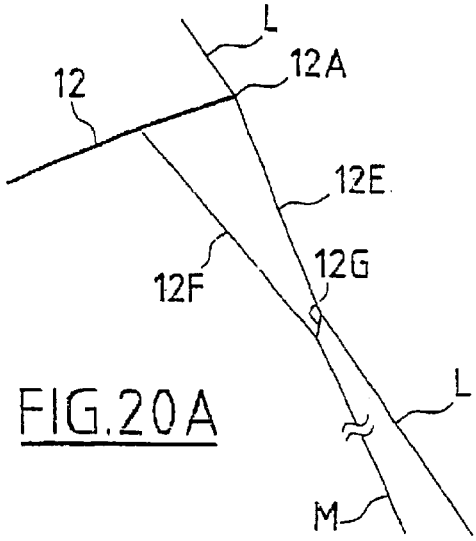
FIGS. 20A and 20B are diagrammatic section views on the plane of symmetry of a kite belonging to the sail, each figure showing different configurations for connecting the kite to a craft of the invention.
Figure 20B:
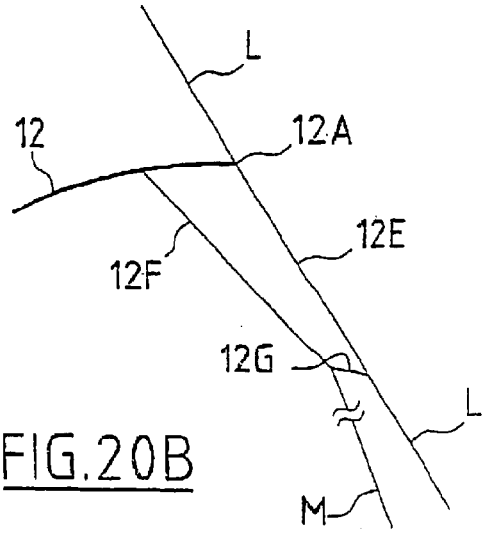

FIGS. 20A and 20B show in detail, for the sail, a possible configuration of the launching sheet L on the sheet M that is different from the configuration shown in FIG. 1A. In FIGS. 20A and 20B, the sheet L is connected to the leading edge 12A of the canopy 12, thereby doubling the first row 12E of shroud lines 12D, and also the second row 12F of shroud lines 12D via a link 12G so that tension action on the sheet L modifies both the angle of inclination of the leading edge 12A relative to the wind, and also the curvature 12C of the canopy 12.

In addition, a variant (not shown) consists in replacing the main traction sheet M with two sheets M1 and M2 providing the same functions as the sheet M but also making it possible to co-operate with the directional sheets P and Q insofar as each of the sheets M1, M2 takes up shroud lines 12D respectively from the left half or from the right half of the main kite canopy 12.

Another configuration (not shown) consists in disposing a main kite canopy 12 analogous to a parafoil but provided with fins imparting improved stability to it. Kites of this type exist that are of very large area. Since the main traction sheet M is not subjected to much stress during launching, which is always performed by means of the sheet L, the curvature and the trim of each kite of this type may be defined for a given point of sailing. Because of its high drag, this type of kite is not the most suitable for close-hauled sailing.

Structured kites, such as delta wings and derivatives thereof and kites analogous thereto, Cody box kites, and semi-rigid kites may also be implemented as the main kite 12. Their relatively small unit areas can lead to providing trains of kites to obtain large sail areas. In which case, launching is highly simplified, and requires neither a pilot kite nor an auxiliary mast.

However, it is preferable to have a launching sheet that operates analogously to the above-described sheet L. This launching sheet is fixed to the front portion(s) of the kite(s) in order to provide low traction, a good ascending force, and good stability during launching and bringing down of the sail (like the sheet J which is described in detail below).

The pilot kite 14 may be constituted by one or more kites of various types. The head kite is preferably a structured kite that is easy to launch. In order to provide a sufficient ascending force, it is adapted to the wind speed at the time of launching.

In addition, the pilot kite 14, which is always in the path of the wind, can hinder positioning of the main kite canopy 12 when sailing close-hauled. In order to mitigate this drawback, the pilot kite 14 is provided with an additional sheet J shown in dashed lines in FIGS. 10A and 10B) directly connected to the craft and placed on the kite 14 so that its traction is substantially neutralized as soon as the additional sheet J is under tension. It is necessary merely to shorten said sheet J in order to release the pilot kite from the main kite. It is also possible to use said sheet J to bring it down.

Another solution consists in providing the pilot kite 14 with two directional sheets S1 and S2 performing substantially the same functions as the sheets P and Q.

Figure 21:
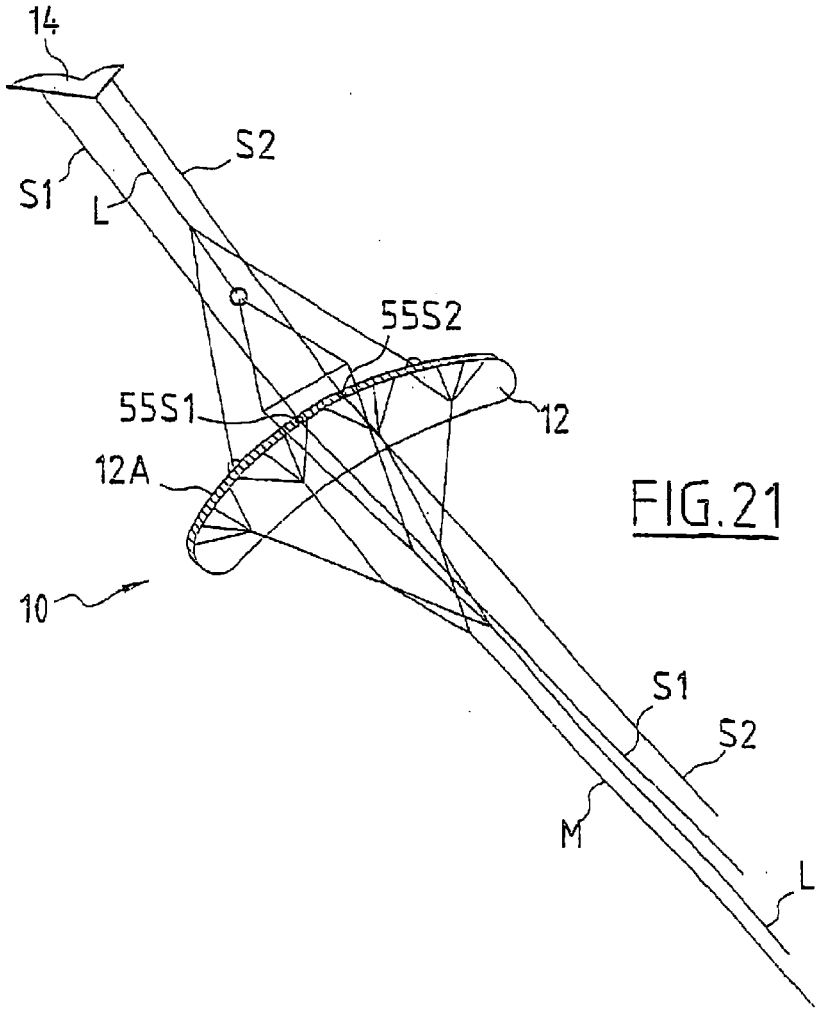
FIG. 21 is a perspective view of a variant configuration of the sail of the invention.

Said sheets S1 and S2 can thus be used jointly with the sheets P and Q to modify the position of the sail relative to the path of the wind. But said sheets S1 and S2 can also replace the sheets P and Q so that they alone position the sail relative to the path of the wind, as shown in FIG. 21.

In any event, it is necessary to adapt the rig of the invention accordingly, in particular firstly by providing guide members 55S1 and 55S2 on the leading edge 12A of the main kite canopy 12 for the purpose of guiding respective ones of the sheets S1 and S2, and secondly by disposing additional reels 60S1, 60S2, and additional guide members 56S1, 56S2 for each of the sheets, the additional reels being placed on the reeling axis 62 and controlled like the reels 60P and 60Q. These additional means are shown in fine dashed lines in FIGS. 8A and 8B.

Figure 22:
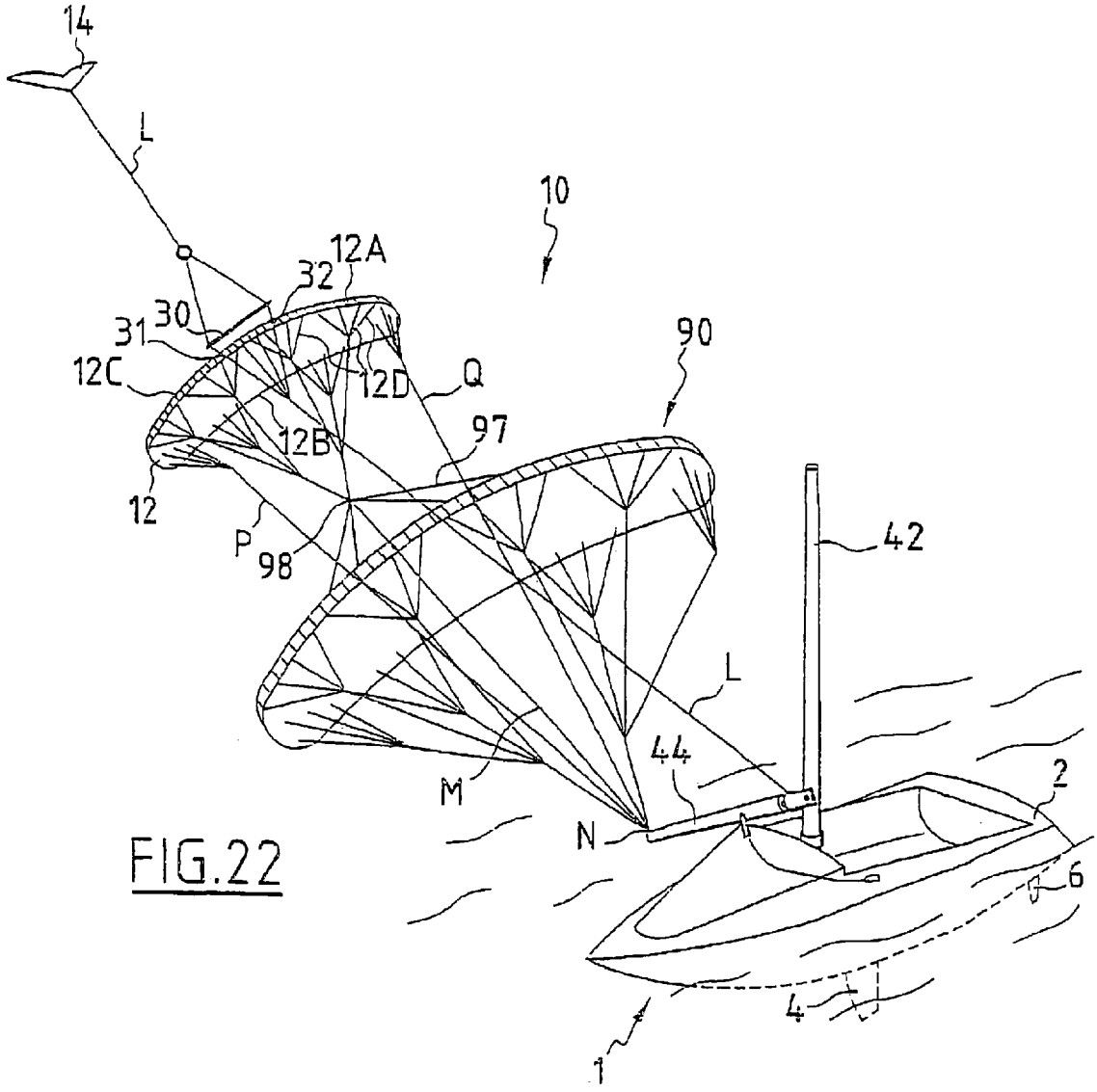
FIG. 22 is a perspective view analogous to the view in FIG. 1, showing an additional canopy.
Figure 23:
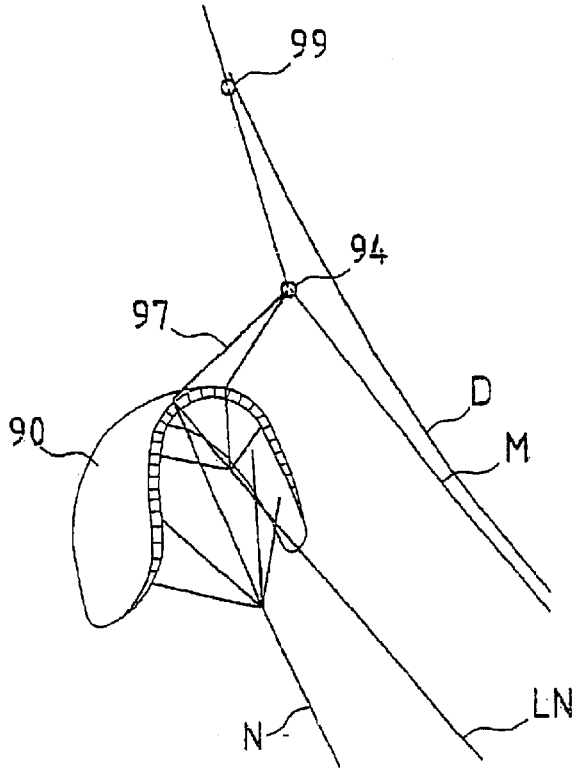
FIG. 23 is a perspective view of the additional canopy of FIG. 22 while it is being launched by a halyard.

In light or moderate winds, it is possible, according to the invention, to launch an additional canopy 90 shown in FIGS. 22 and 23 and whose area is equal to several times the area of the main kite canopy, e.g. in the range three times to eight times. The canopy 90 is chosen as a function of the desired point of sailing: high curvature and very large area for running (like a spinnaker), medium or low curvature and large area for close-hauled sailing (like a Genoa jib). For the purpose of launching it, the additional canopy 90 is applied against the main traction sheet M of the canopy already launched. Its leading edge is entrained by the traction from the main kite canopy 12 via lines 97. Two practical solutions can be envisaged:

launching of the main kite canopy 12 is interrupted half-way; the leading edge of the additional canopy 90 is connected to the main traction sheet M of the canopy 12 being launched at a point of convergence 98. Launching the main kite canopy is then completed, thereby also launching the additional canopy; this solution is quite suitable when cruising in a stable wind; or during the launching, a pulley 99 and a halyard D are fixed to the sheet of the main kite canopy. Said halyard is then used in turn to launch the additional canopy 90 via a pulley 94 bearing on the sheet M. The additional canopy 90 is provided with a launching sheet LN connected to the leading edge of the canopy 90. LN thus plays the same part as the sheet L for the main kite canopy 12. This solution (shown in FIGS. 23 and 24) is more suitable when racing or in variable winds.

Figure 24:
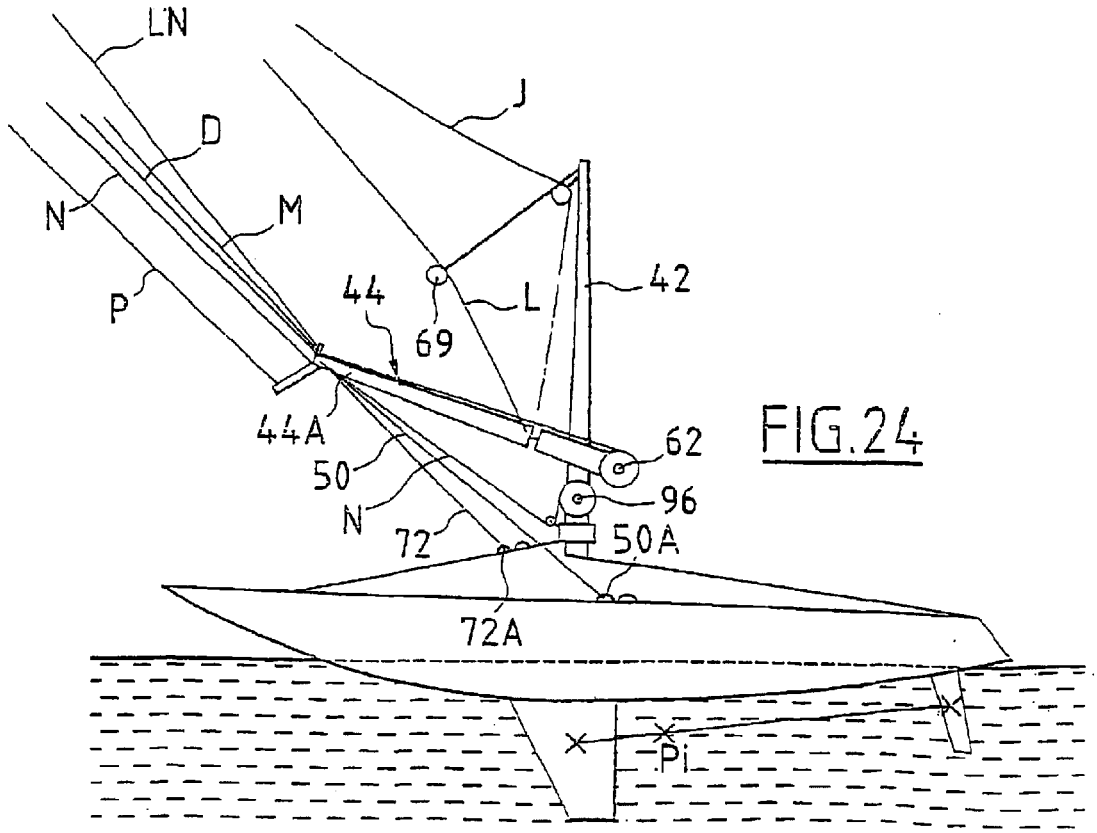
FIG. 24 is a view analogous to FIG. 4, showing a configuration of means of the invention for connecting the additional canopy to the craft.

Generally, such additional canopies 90 have a single main traction sheet N and are "guided" by the main kite canopy 12 of the sails. They may have sheets for controlling curvature. Such sheets and the halyard D are wound on reels placed on an independent shaft 96 and dismountable for the purpose of being stowed with the canopy. In order to reduce stresses, the reels, and the guides and the cleats for the sheets of the additional canopy 90 are fixed to the auxiliary mast 42, as shown in FIG. 24.

When the additional canopy is of the spinnaker type that cannot be used on close-hauled courses, the reels, the guides, and the cleats of the additional canopy may be placed directly on the deck, forward of the mast.

On large vessels, it is even possible to consider having a fourth canopy bearing on the sheet N and whose area is several times the area of the additional canopy 90.

As can be understood, all of the examples of operation of the above-described craft can be envisaged only for wind forces greater than a minimum threshold, necessary for at least keeping the sail up, which threshold is, in principle, equal to force 2 on the Beaufort scale.

What is claimed is:

1. A water craft, comprising a floating body, drift means adapted to generate a lateral resistance effect for opposing leeward drift, and a rig which comprises:

at least one steerable kite forming a sail, a series of control sheets for controlling the sail and connected to the craft, the series of control sheets comprising at least one main traction sheet and at least two directional sheets, trimming means for three-dimensionally trimming the axis of the traction resultant exerted by the sail on the craft so that it is possible to eliminate heeling substantially completely, said trimming means comprising both positioning means for positioning the sail relative to the longitudinal axis of the craft that are adapted to hold the traction sheet in a desired direction relative to the longitudinal axis of the craft and that include at least one guide member substantially at a point for guiding the traction sheet and for applying the traction from the traction sheet to the craft, and also adjustment means for adjusting the angular position of the sail relative to the wind that include the directional sheets, said positioning and adjustment means being adapted to set the course of the craft relative to the apparent wind, optionally on their own, with said guide member situated above the water level, regardless of the point of sailing of the craft, and launching means for deploying the sail and for bringing it back down, which comprise a launching sheet connecting the leading edge of the steerable kite to the craft and an auxiliary kite connected to the leading edge of the steerable kite.

2. A craft according to claim 1, wherein said guide member is situated at the end of an arm, and is placed outside the overall plan area of the craft, at least on close-hauled points of sailing.

3. A craft according to claim 1, wherein said trimming means further make it possible to adjust heeling substantially to a chosen non-zero value for a given non-zero angle of the longitudinal axis of the craft relative to the direction of the wind, for a given force of said wind, and for given positions of moveable masses on the craft.

4. A craft according to claim 1, wherein the trimming means are adapted to cause the axis of the traction resultant to pass:

either substantially through the point of application of the lateral resistance force exerted by the craft, or, for a craft whose moveable masses define a weight resultant that has a non-negligible effect on the transverse balance of the craft, a short distance from the point of application of the lateral resistance force exerted by the craft, so that said traction resultant participates in balancing said weight resultant of the moveable masses.

5. A craft according to claim 1, wherein the directional sheets are also adapted to control the shape of the steerable kite, its curvature and/or the angular position of its leading edge relative to the wind.

6. A craft according to claim 1, wherein the craft further comprises elements hydrodynamically lightening the floating body.

7. A craft according to claim 1, wherein the rig further comprises a mast secured to the craft, and wherein the positioning means and the adjustment means further comprise, on the one hand, additional guide members for guiding the directional sheets, each directional sheet being provided with at least one of said additional guide members, the mutual dispositions of at least some of the at least one guide member and the additional guide members, and adjustment of the lengths of the traction and directional sheets defining the angular position of the axis of the traction resultant and, on the other hand, a spar which is mounted on the mast and on which the at least one guide member and the additional guide members are mounted, which is connected to the sail via the traction and directional sheets associated with said guide members and which, for positioning the sail relative to the craft, is both mounted to turn about the axis of the mast and also mounted to pivot about an axis substantially perpendicular to the axis of the mast.

8. A craft according to claim 7, wherein the positioning means comprise two side positioning stays whose lengths can be adjusted, and each of which extends from the spar to a side anchor location, the anchor locations being situated on either side of and remote from the plane of symmetry of the craft, and wherein the positioning means further comprise a bottom positioning stay whose length can be adjusted and which extends from the spar to a bottom anchor location situated substantially in the midplane of the craft, the side and bottom positioning stays being adjustable, remotely or jointly, to cooperate with adjusting the heeling and to define the course of the craft.

9. A craft according to claim 7, wherein the mast is secured to the craft by being disposed forward of the point of application of the lateral resistance force.

10. A craft according to claim 1, wherein the auxiliary kite is made up of several wings or airfoils of analogous type or of different type.

11. A craft according to claim 1, wherein the auxiliary kite is connected to the craft via two directional auxiliary sheets which cooperate with the adjustment means or which exclusively position the sail relative to the wind.

12. A craft according to claim 1, wherein the rig further comprises at least one additional kite canopy and a corresponding main traction sheet, said at least one additional kite canopy being connected to one of the traction sheets of the steerable kite and of the other additional kite so as to be launched with said steerable kite or else, once the steerable kite is flying in established manner, so as to be launched by a halyard fixed to the traction sheet to which said at least one additional kite canopy is connected.

13. A craft according to claim 12, wherein the craft further comprises a reversible reeling device for the sheet of the additional kite, this device being dismountable with respect to the craft body and stowable with the additional kite.

14. A craft according to claim 1, wherein the craft further comprises a reversible reeling device for the traction, directional and launching sheets, adapted to stow all these sheets when the sail is unused and to tighten only the launching sheet during the deploying and the bringing back down of the sail.

15. A craft according to claim 14, wherein, for each traction, directional and launching sheet, the reeling device comprises a reel provided with means for tightening the corresponding sheet, the reels being mounted about a respective common axis on a respective common drive shaft, the tightening means comprising an adjustable brake adapted to transmit drive torque, which may optionally be zero, between the drive shaft and each reel.

16. A craft according to claim 14, wherein the reeling device is supported by an auxiliary mast mounted to turn about a base mast built into the body of the craft.

17. A craft according to claim 1, wherein the launching sheet is provided with a batten oriented substantially parallel to the leading edge of the steerable kite, said batten being connected to at least two points of a central part of said leading edge.

18. A craft according to claim 1, wherein the auxiliary kite is a delta wing.

19. A craft according to claim 1, wherein the auxiliary kite is provided with a central stabilizer fin adapted to impart a curvature in a plane of symmetry of the auxiliary kite.

20. A craft according to claim 1, wherein the launching sheet is hinged about a guiding member situated vertically above the craft and whose height is adjustable.

21. A craft according to claim 1, wherein the drift means comprise at least one leeboard projecting from beneath the floating body.

22. A craft according to claim 1, wherein the at least one guide member is lying in the midplane of the craft and forward of the point of application of the lateral resistance force, the end of the traction sheet being connected to the craft at this guide member.

23. A craft according to claim 22, wherein, in the end of the traction sheet that is connected to the craft, the traction sheet is made up of a first line guided by the at least one guide member, and a second line and a third line respectively guided by second and third guide members of the positioning means, these second and third guide members being situated on either side of and remote from said midplane, each at the end of a support arm extending transversely to the craft.

24. A craft according to claim 23, wherein the support arm is dismountable or retractable by means of a control device.

* * * * *